US011506401B2

(12) United States Patent
Hwang et al.

(10) Patent No.: US 11,506,401 B2
(45) Date of Patent: Nov. 22, 2022

(54) CEILING TYPE AIR CONDITIONER

(71) Applicant: LG ELECTRONICS INC., Seoul (KR)

(72) Inventors: Bonchang Hwang, Seoul (KR); Beomsoo Seo, Seoul (KR); Dongig Oh, Seoul (KR); Joonshik Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 417 days.

(21) Appl. No.: 16/616,530

(22) PCT Filed: May 25, 2018

(86) PCT No.: PCT/KR2018/005992
§ 371 (c)(1),
(2) Date: Nov. 25, 2019

(87) PCT Pub. No.: WO2018/217069
PCT Pub. Date: Nov. 29, 2018

(65) Prior Publication Data

US 2020/0103125 A1 Apr. 2, 2020

(30) Foreign Application Priority Data

May 25, 2017 (KR) ..... 10-2017-0064531

(51) Int. Cl.
*F24F 1/00* (2019.01)
*F24F 13/12* (2006.01)
(Continued)

(52) U.S. Cl.
CPC ..... *F24F 1/0047* (2019.02); *F24F 1/0014* (2013.01); *F24F 1/0038* (2019.02);
(Continued)

(58) Field of Classification Search
CPC ..... F24F 1/0047; F24F 1/0038; F24F 1/0014; F24F 13/12; F24F 13/14; F24F 13/1426; F24F 2013/1433; F24F 2013/1446
See application file for complete search history.

(56) References Cited

U.S. PATENT DOCUMENTS 6,141,983 A 11/2000 Nishikawa et al.
10,718,545 B2 * 7/2020 Tomohito ..... F24F 13/1413
(Continued)

FOREIGN PATENT DOCUMENTS

CN 203980447 12/2014
CN 104713164 6/2015
(Continued)

OTHER PUBLICATIONS

International Search Report dated Aug. 31, 2018 issued in Application No. PCT/KR2018/005992.
(Continued)

*Primary Examiner* — Marc E Norman
(74) *Attorney, Agent, or Firm* — Ked & Associates

(57) ABSTRACT

A ceiling type air conditioner including an indoor unit having a built-in heat exchanger and a built-in blower, and having a plurality of blowing passages for discharging, to the outside, air having passed through the heat exchanger; a discharge panel having a plurality of inlets into which air discharged through the plurality of blowing passages is delivered, an inner space at least partially communicating with the partiality of inlets, and a ring-or arc-shaped opening for discharging, into a room, air flowing into the inner space; and an air guide module mounted to the discharge panel, and moved upward and downward or rotated so as to vary airflow discharged through the opening.

19 Claims, 20 Drawing Sheets

(51) Int. Cl.

| | |
|---|---|
| ***F24F 13/14*** | (2006.01) |
| ***F24F 1/0047*** | (2019.01) |
| ***F24F 1/0038*** | (2019.01) |
| ***F24F 1/0014*** | (2019.01) |

(52) U.S. Cl.
CPC ..... *F24F 13/12* (2013.01); *F24F 13/14* (2013.01); *F24F 13/1426* (2013.01); *F24F 2013/1433* (2013.01); *F24F 2013/1446* (2013.01)

(56) References Cited

U.S. PATENT DOCUMENTS

| | | | | |
|---|---|---|---|---|
| 2016/0076790 | A1 | 3/2016 | Kojima | |
| 2018/0038613 | A1 | 2/2018 | Tomohito et al. | |
| 2020/0309406 | A1* | 10/2020 | Ryu ..... | F24F 1/0047 |
| 2022/0049858 | A1* | 2/2022 | Kim ..... | F24F 1/0047 |

FOREIGN PATENT DOCUMENTS

| | | |
|---|---|---|
| CN | 205316615 | 6/2016 |
| CN | 205372765 | 7/2016 |
| CN | 106066060 | 11/2016 |
| EP | 3091296 | 11/2016 |
| EP | 3150927 | 4/2017 |
| JP | 2001-201165 | 7/2001 |
| KR | 10-2007-0060502 | 6/2007 |
| KR | 10-2008-0035946 | 4/2008 |
| KR | 10-0897425 | 5/2009 |
| KR | 10-1623692 | 5/2016 |
| KR | 10-2016-0091290 | 8/2016 |
| KR | 10-2017-0048128 | 5/2017 |
| WO | WO 2016/133261 | 8/2016 |
| WO | WO 2017/069437 | 4/2017 |

OTHER PUBLICATIONS

Chinese Office Action dated Nov. 3, 2020 issued in CN Application No. 201880034414.2.

European Search Report dated Feb. 4, 2021 issued in Application No. 18806773.0.

Korean Office Action dated Feb. 25, 2021 issued in KR Application No. 10-2017-0064531.

* cited by examiner (a) WHEN AIR GUIDE IS LOWERED (b) WHEN AIR GUIDE IS LIFTED

CEILING TYPE AIR CONDITIONER

CROSS-REFERENCE TO RELATED PATENT APPLICATIONS

This application is a U.S. National Stage Application under 35 U.S.C. § 371 of PCT Application No. PCT/KR2018/005992, filed May 25, 2018, which claims priority to Korean Patent Application No. 10-2017-0064531, filed May 25, 2017, whose entire disclosures are hereby incorporated by reference.

TECHNICAL FIELD

The present disclosure relates to a ceiling type air conditioner.

BACKGROUND ART

An air conditioner is a device that creates a more comfortable indoor environment for a user.

An air conditioner may cool or heat a room by using a refrigerating cycle apparatus including a compressor, a condenser, an expansion mechanism, and an evaporator through which a refrigerant is circulated.

The air conditioner may be classified into a stand type air conditioner, a wall-mounted air conditioner, and a ceiling type air conditioner according to installation positions.

The ceiling type air conditioner is installed on the ceiling to discharge cold or warm air into the room.

Recently, ceiling type air conditioners having a circular shape have been manufactured.

For example, referring to Korean Patent Publication No. 10-0897425, an air conditioner including a front panel having an open portion formed with an intake port through which external air is introduced and a discharge port through which the introduced internal air is discharged and a separating guide provided in the open portion of the front panel and having a ring shape so that the intake port is located on an inner side and the discharge port is located at an outer circumference is disclosed.

According to the air conditioner of the related art as described above, heat-exchanged air may be evenly discharged in all directions (360°) in the room through the ring-shaped integrated discharge port.

However, the circular air conditioner as described above has a problem in that a vane for controlling an air flow angle is omitted due to a structural defect that a gap is formed at a central portion, and thus, air flow control is not smoothly performed.

In addition, it is necessary to induce a horizontal air flow to provide indirect air to the user in the case of cooling and it is necessary to induce a vertical air flow to prevent air returning (short-circuit) in the case of heating, but the circular air conditioner of the related art is difficult to induce both horizontal and vertical air flows.

In addition, during the heating operation, a weakly spreading flow is re-absorbed at a corner of the discharge port, thereby degrading performance of the air conditioner.

DISCLOSURE

Technical Problem

In order to solve the problems of the related art as described above, the present disclosure provides a ceiling type air conditioner in which an air flow is controlled by moving an end of a flow path of a circular cassette up and down, thereby precisely controlling an angle of a discharge air flow.

The present disclosure also provides a ceiling type air conditioner which has a relatively simple structure and is capable of precisely control an air flow by only a simple operation.

The present disclosure also provides a ceiling type air conditioner capable of inducing a horizontal air flow to provide indirect air to a user in the case of cooling and capable of inducing a vertical air flow to prevent air returning (short-circuit) in the case of heating.

The present disclosure also provides a ceiling type air conditioner capable of preventing an air returning phenomenon that a discharged air flow is intaken back and solving a problem of a degradation of performance due to return air.

The present disclosure also provides a ceiling type air conditioner capable of strengthening a horizontal air flow for wide cooling, strengthening a vertical air flow for intensive heating, and forming a swing air flow as necessary.

The present disclosure also provides a ceiling type air conditioner which may be perfectly received in a discharge panel so as not to affect a discharge air flow according to circumstances.

Technical Solution

To solve the technical problem as described above, there is provided a ceiling mounted air conditioner including: an indoor unit having a built-in heat exchanger and a built-in blower and comprising a plurality of blowing passages configured to discharge air which passes through the heat exchanger to the outside; a discharge panel comprising a plurality of inlets receiving the air discharged through the plurality of blowing passages, an inner space configured to at least partially communicate with the plurality of inlets, and a ring-shaped or arc-shaped opening configured to discharge, to a room, air which flows into the inner space; and an air guide module mounted on the discharge panel and configured to be lifted/lowered or rotated to vary a flow of the air discharged to the opening.

The inner space of the discharge panel may include a flow region configured to communicate with each inlet and allow air which flows through the inlet to flow therein, the flow region being provided in plurality, and a blocking region provided between the plurality of flow regions, and the air guide module is mounted at the flow region.

The ceiling type air conditioner may further include: a barrier configured to divide the inner space of the discharge panel into the flow region and the blocking region.

The flow region and the blocking region may be alternately located along a circumference of the discharge panel.

The opening may include a first opening region corresponding to the flow region and a second opening region corresponding to the blocking region, and the air guide module may be mounted at the first opening region.

The first opening region and the second opening region may be alternately located along a circumference of the discharge panel.

The air guide module may include: at least one air guide liftably/lowerably or rotatably disposed at the discharge panel and configured to vary a flow of the air discharged to the opening; a power generator configured to provide power for lifting/lowering or rotating the air guide; and a power transmitter configured to lift/lower or rotate the air guide upon receiving power from the power generator.

The power generator may be provided as a motor configured to provide a rotating power, and the power transmitter may include a pinion gear connected to a rotary shaft of the motor and a rack gear lifted or lowered in mesh with the pinion gear to lift or lower the air guide.

The discharge panel may include: a main flow path body comprising an upper body portion and an outer body portion provided on an outer side of the upper body portion, the upper body portion and the outer body portion being connected by a connecting portion; and an inner flow path body provided on an inner side of the main flow path body to form the inner space with the main flow body.

The air guide module may be mounted at an end portion of the main flow path body or the inner flow path body.

The air guide module may include an air guide drawn into or out from the main flow path body or the inner flow path body.

A surface of the air guide module which faces the inner space may be configured as a flat surface to guide a horizontal air current when the air guide module is lifted, and to guide a vertical air current when the air guide module is lowered.

The main flow path body and the inner flow path body may have an inclined surface inclined downward toward the opening.

The main flow path body and the inner flow path body may have a surface which is curved so that the inner space forms a curved line toward an outer side.

Advantageous Effect

According to the present disclosure, an air flow is controlled by moving the end of the flow path of the circular cassette up and down, thereby precisely controlling the angle of the discharge air flow.

Furthermore, there is an effect that an air flow may be precisely controlled only by a simple operation, while the structure is relatively simple.

Furthermore, it is possible to induce a horizontal air flow to provide indirect air to the user in the case of cooling and it is also possible to induce a vertical air flow to prevent air returning in the case of heating.

Furthermore, it is possible to prevent the phenomenon that a discharged air flow is intaken back and to solve the problem of deterioration of performance due to return air.

Furthermore, it is possible to inlet the horizontal air flow for wide cooling, to strengthen the vertical air flow for intensive heating, and to form a swing air flow.

Furthermore, there is an effect that the ceiling mounted air conditioner may be perfectly received in the discharge panel so as not to affect a discharge air flow according to circumstances.

MODE FOR INVENTION

Hereinafter, embodiments of the present disclosure will be described in detail with reference to the accompanying drawings.

Figure 1:
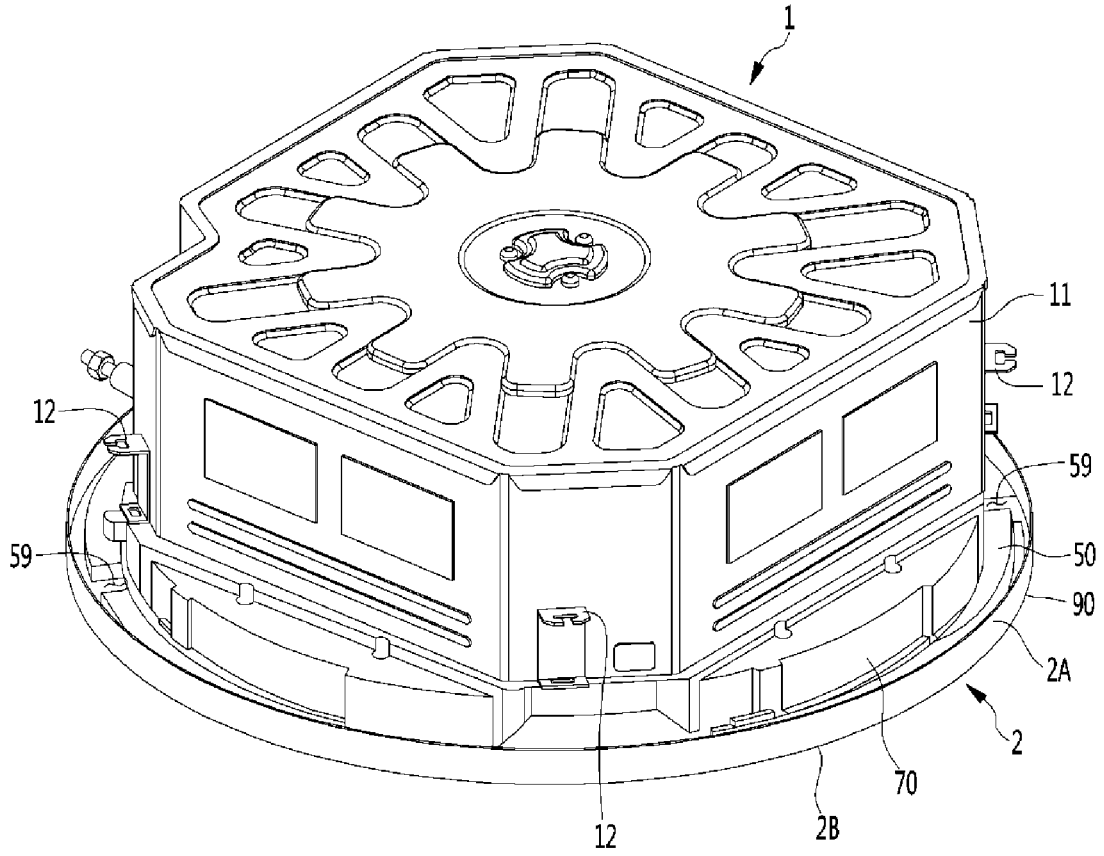
FIG. 1 is a perspective view of a ceiling type air conditioner according to an embodiment of the present disclosure.
Figure 2:
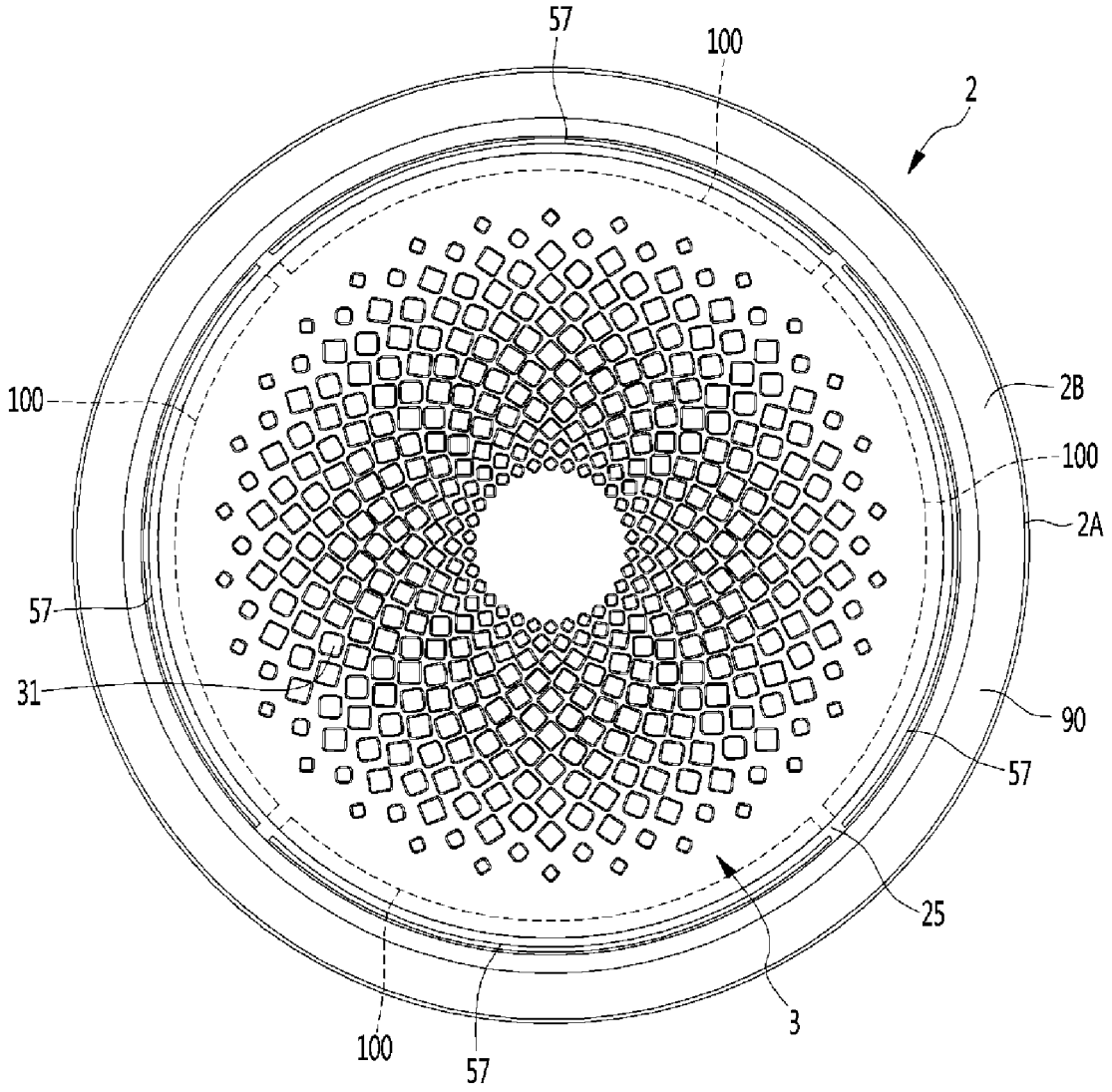
FIG. 2 is a bottom view of a ceiling type air conditioner according to an embodiment of the present disclosure.
Figure 3:
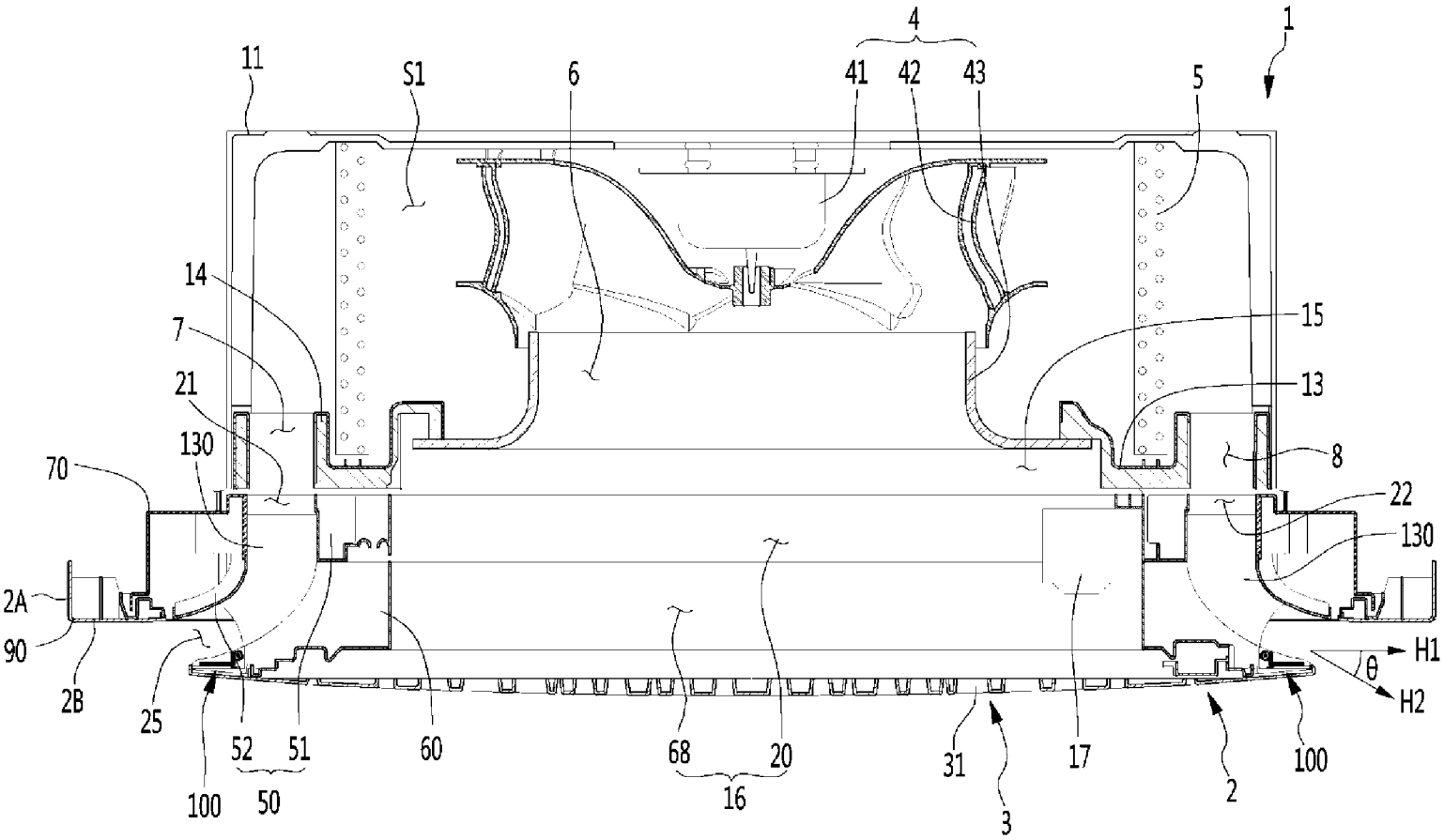
FIG. 3 is a longitudinal cross-sectional view of a ceiling type air conditioner according to an embodiment of the present disclosure.
Figure 4:
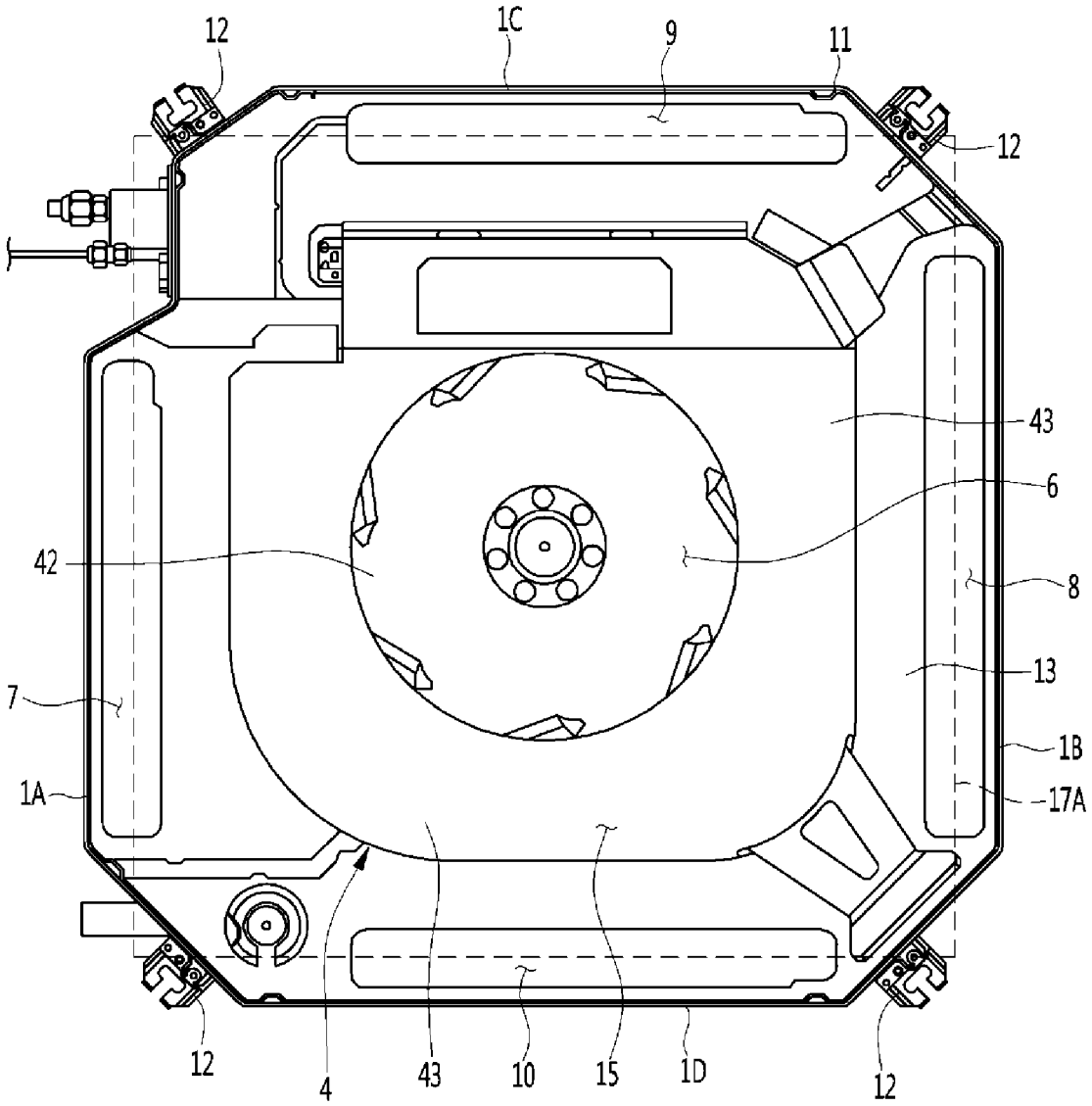
FIG. 4 is a bottom view of an indoor unit shown in FIGS. 1 and 3.

FIG. 1 is a perspective view of a ceiling type air conditioner according to an embodiment of the present disclosure, FIG. 2 is a bottom view of a ceiling type air conditioner according to an embodiment of the present disclosure, FIG. 3 is a longitudinal cross-sectional view of a ceiling type air conditioner according to the present disclosure, and FIG. 4 is a bottom view of an indoor unit illustrated in FIGS. 1 and 3.

An indoor unit 1 may include a blower 4 and a heat exchanger 5. The indoor unit 1 may intake air, exchange heat with a refrigerant, and then blow air to a discharge panel 2. The indoor unit 1 may configure a main body of the ceiling type air conditioner.

The indoor unit 1 may further include an indoor unit flow path body 13 partitioning a region 15 through which air is intaken into the indoor unit 1 and regions 7, 8, 9, and 10 through which air inside the indoor unit 1 is blown to the discharge panel 2.

The indoor unit 1 may further include a drain unit 14 disposed below the heat exchanger 5.

An inner intake 6 through which the air intaken through an intaking panel 3 is intaken into the indoor unit 1 may be formed at the indoor unit 1. In addition, a plurality of blowing passages 7, 8, 9, and 10 discharging and guiding air passing through the heat exchanger 5 may be formed at the indoor unit 1.

The indoor unit 1 may discharge air in a downward direction through the plurality of blowing passages 7, 8, 9, and 10. The indoor unit 1 may form a plurality of discharge air flows blown in the downward direction in the interior of the indoor unit 1. The plurality of discharge air flows may be blown in parallel directions.

An outer circumference of the indoor unit 1 may have a polygonal shape. The plurality of blowing passages 7, 8, 9, and 10 may be formed to be open in an up-down direction on the bottom of the indoor unit 1. The indoor unit 1 may discharge a plurality of vertical air flows blown in the downward direction through a bottom surface thereof.

The indoor unit 1 may be installed to be hung on the ceiling. The indoor unit 1 may be supported by fastening members such as anchor bolts fixed to the ceiling. The indoor unit 1 may have a fastening portion 12 to which a fastening member is fastened.

The indoor unit 1 may include a chassis 11 forming an appearance. The chassis 11 may be an indoor unit body forming the appearance of the indoor unit.

The chassis 11 may be mounted at the ceiling by a fastening member such as an anchor bolt. A fastening portion 12 to which the fastening member such as an anchor bolt or the like is fastened may protrude from the chassis 11.

The chassis 11 may include a combination of a plurality of members. The chassis 11 may have a polyhedral shape in which a bottom surface is open and a space is formed therein.

The chassis 11 may have a space in which the blower 4 and the heat exchanger 5 are accommodated. The chassis 11 may have a shape in which four sides of front, rear, left, and right and a top surface are blocked. The bottom of the chassis 11 may be open.

The blower 4 may be disposed in the chassis 11. The blower 4 may be mounted on a top plate of the chassis 11.

The blower 4 may be mounted at the chassis 11 such that at least a portion thereof is located inside the heat exchanger 5.

The blower 4 may be mounted to be located above the upper hollow portion 20 (to be described later) of the discharge panel 2.

The blower 4 may be configured as a centrifugal blower that intakes air below and blows the air in a centrifugal direction. The blower 4 may include a motor 41 and a centrifugal fan 42 connected to the motor 41. The blower 4 may include an orifice 43 for guiding air intaken into the centrifugal fan 42.

The motor 41 may be mounted such that a rotary shaft connected to the centrifugal fan 42 protrudes downward.

The centrifugal fan 42 may be configured as a turbo fan.

The orifice 43 may be installed to be located inside the chassis 11. The orifice 43 may be installed at the indoor unit flow path body 13 (to be described later). An inner intake 6 may be formed at the orifice 43.

Air passing through the intake panel 3 may be intaken into the centrifugal fan 42 through the inner intake 6 of the orifice 43 and blow in the centrifugal direction of the centrifugal fan 42 by the centrifugal fan 42.

The air blown from the centrifugal fan 42 in the centrifugal direction may flow to the heat exchanger 5 arranged to surround the outer circumference of the centrifugal fan 42 and may exchange heat with the heat exchanger 5.

The heat exchanger 5 may be bent at least once. The heat exchanger 5 may be smaller than the chassis 11 and disposed inside the chassis 11.

The heat exchanger 5 may be disposed in a quadrangular shape or a hollow cylindrical shape inside the chassis 11.

The heat exchanger 5 may be spaced apart from an inner surface of the chassis 11. A passage through which air is guided to the air flow passages 7, 8, 9, and 10 (to be described later) may be formed between the heat exchanger 5 and the inner surface of the chassis 11.

The heat exchanger 5 may be bent to form a space S1 in which the blower 4 is accommodated. The heat exchanger 5 may include four heat exchanging parts facing different sides of the chassis 11. The heat exchanger 5 may surround an outer circumferential surface of the blower 4 on the outside of the blower 4.

An upper surface of the drain unit 14 may be formed to be open, and a space in which a lower portion of the heat exchanger 5 may be accommodated may be formed therein.

The indoor unit flow path body 13 may be coupled to the drain unit 14. The indoor unit flow path body 13 may have a hollow portion 15 through which air may pass in an up-down direction. The hollow portion 15 may be an indoor unit air intake through which air from a lower portion of the indoor unit 1 is intaken into the indoor unit 1. The hollow portion 15 may be a region through which air is intaken into the indoor unit 1.

The indoor unit flow path body 13 may be disposed at an inner lower portion of the chassis 11. The indoor unit flow path body 13 may form the bottom appearance of the indoor unit 1.

Each of the plurality of blowing passages 7, 8, 9, and 10 formed in the indoor unit 1 may have a polygonal cross-sectional shape. Each of the plurality of blowing passages 7, 8, 9, and 10 may have a quadrangular cross-sectional shape.

The plurality of blowing passages 7, 8, 9, and 10 may be regions in which air inside the indoor unit 1 is blown to the discharge panel 2.

The plurality of blowing passages 7, 8, 9, and 10 may be formed to be spaced apart from the inner intake 6.

As illustrated in FIG. 4, the plurality of blowing passages 7, 8, 9, and 10 may include a left blowing passage 7, a right blowing passage 8, and a front blowing passage 9 and a rear blowing passage 10.

As shown in FIG. 4, the plurality of blowing passages 7, 8, 9, and 10 may be formed along a quadrangular virtual line 17A and the plurality of blowing passages 7, 8, 9, and 10 may be formed on the surfaces of the quadrangular virtual line 17A, respectively.

The left blowing passage 7 may be located close to a left surface 1A, among the left surface 1A and a right surface 1B, of the indoor unit 1 and extend in a front-rear direction.

The right blowing passage 8 may be located close to the right surface 1B, among the left surface 1A and the right surface 1B of the indoor unit 1 and may extend in the front-rear direction.

The front blowing passage 9 may be located close to a front surface 1C, among the front surface 1C and a rear surface 1C, of the indoor unit 1 and extend in a left-right direction.

The rear blowing passage 10 may be located near a rear surface 1D, among the front surface 1C and the rear surface 1D, of the indoor unit 1 and may extend in the left-right direction.

The plurality of blowing passages 7, 8, 9, and 10 may be formed at the indoor unit flow path body 13, and the plurality of blowing passages 7, 8, 9, and 10 may be spaced apart from each other at the indoor unit flow path body 13.

The plurality of blowing passages 7, 8, 9, and 10 may be formed between the indoor unit flow path body 13 and the inner surface of the chassis 11. The plurality of blowing passages 7, 8, 9, and 10 may be spaced apart from each other between the indoor unit flow path body 13 and the inner surface of the chassis 11.

The plurality of blowing passages 7, 8, 9, and 10 may be four opening regions different in positions and parallel to each other in opening directions, and the indoor unit 1 may be formed to discharge air through the plurality of blowing passages 7, 8, 9, and 10.

The indoor unit 1 may be a 4-way discharge type indoor unit that forms four vertical air flows parallel to each other in discharge directions.

The discharge panel 2 may have a circular outer circumference 2A. The discharge panel 2 may have a flat bottom surface 2B.

The discharge panel 2 may be coupled to the indoor unit 1 and discharge air passing through the plurality of blowing passages 7, 8, 9, and 10 to the outside. The discharge panel 2 may be disposed below the indoor unit 1 together with the intake panel 3. The discharge panel 2 may configure a lower body assembly disposed below the indoor unit 1 together with the intake panel 3.

The discharge panel 2 may be coupled to a lower portion of the indoor unit 1 and discharge and guide the air blown in a downward direction through the plurality of blowing passages 7, 8, 9, and 10 into the room.

The discharge panel 2 may receive air blown in four directions parallel to each other in the indoor unit 1 and discharge and guide the air to the lower perimeter of the discharge panel 2.

As shown in FIG. 3, the discharge panel 2 may change a flow of air blown in a vertical direction, in particular, in a downward direction, from the indoor unit 1 into a horizontal direction H1 to discharge and guide the air or may change the flow of air into a lower inclination direction H2 having an acute angle θ of inclination to discharge and guide the air.

The discharge panel 2 may include a combination of a plurality of members 50, 60, 70, and 90.

At least one inlet 21, 22, 23, and 24 (see FIG. 5) communicating with the plurality of blowing passages 7, 8, 9, and 10 of the indoor unit 1 may be provided at the discharge panel 2. In addition, the discharge panel 2 may have an opening 25 having a circular or arc shape.

An inner space 26 may be provided at the discharge panel 2, and the inner space 26 may communicate with the inlets 21, 22, 23, and 24, and the opening 25. This will be described in detail later.

The ceiling type air conditioner may include an air guide module 100 liftably/lowerably disposed at the discharge panel 2 and guiding air passing through the opening 25.

The air guide module 100 may be liftably/lowerably or rotatably disposed at the discharge panel 2.

For example, the air guide module 100 may induce a horizontal air flow of air discharged from the opening 25 when lifted and may induce a vertical air flow when lowered.

The discharge panel 2 may have a receiving space 60*a* so that the air guide module 100 may be received while being lifted around the opening 25 of the discharge panel 2 or lowered into the discharge panel 2.

The receiving space 60*a* may be formed on an upper surface of the discharge panel 2 and open in the up-down direction.

Figure 5:
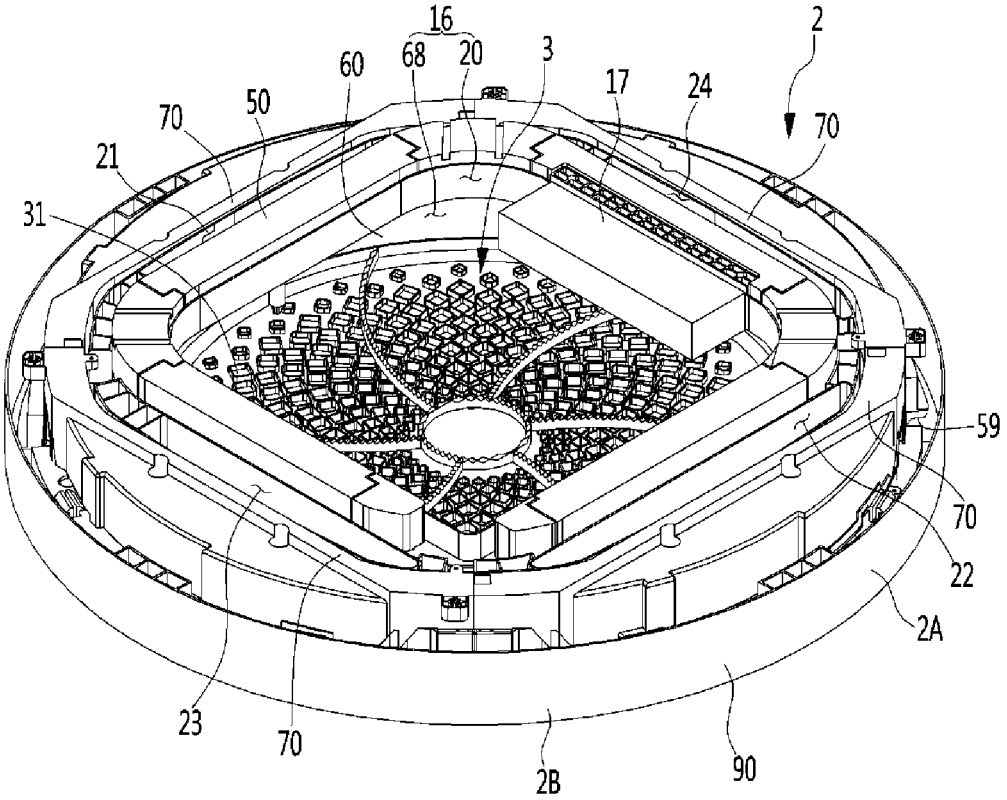
FIG. 5 is a perspective view of a lower body assembly illustrated in FIGS. 1 to 3.
Figure 6:
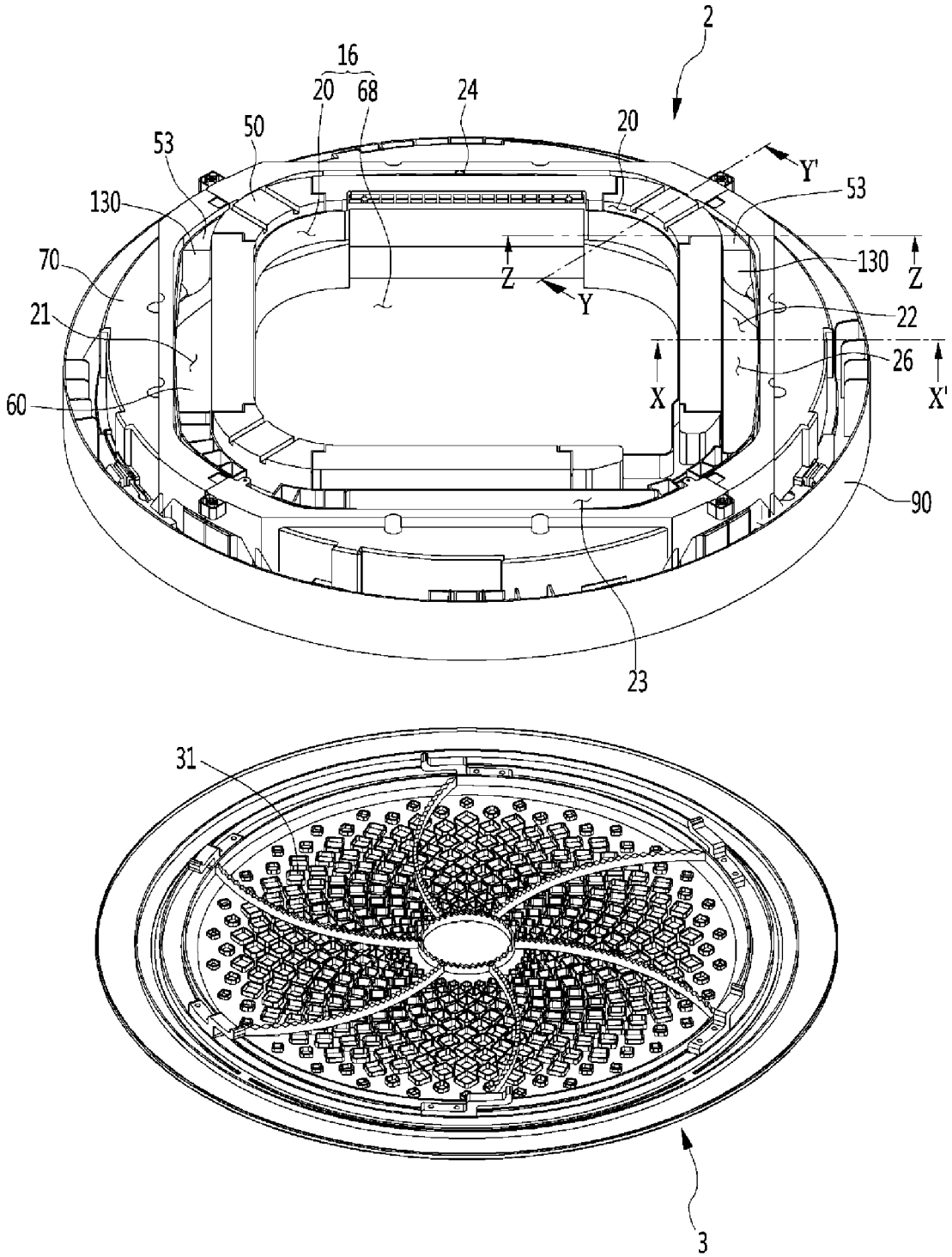
FIG. 6 is a perspective view when a discharge panel and a suction panel are separated from the lower body assembly shown in FIG. 5.
Figure 7:
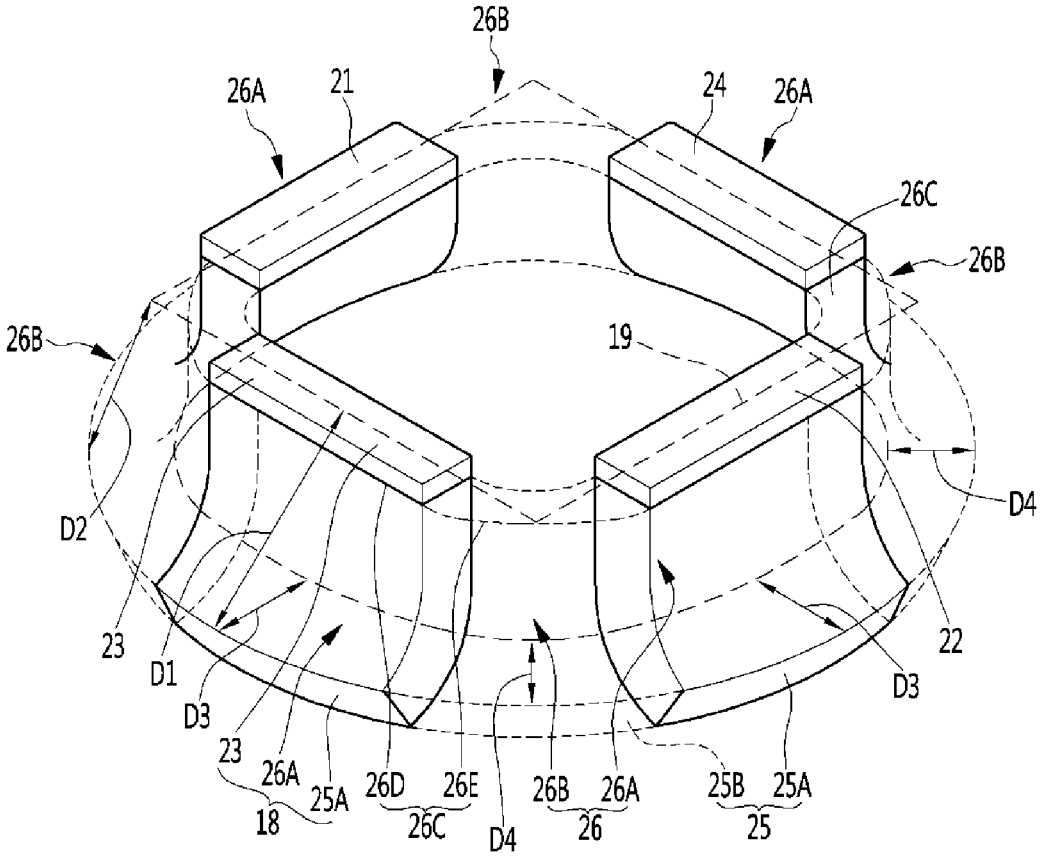
FIG. 7 is a perspective view illustrating a discharge flow path of a discharge panel according to an embodiment of the present disclosure.
Figure 8:
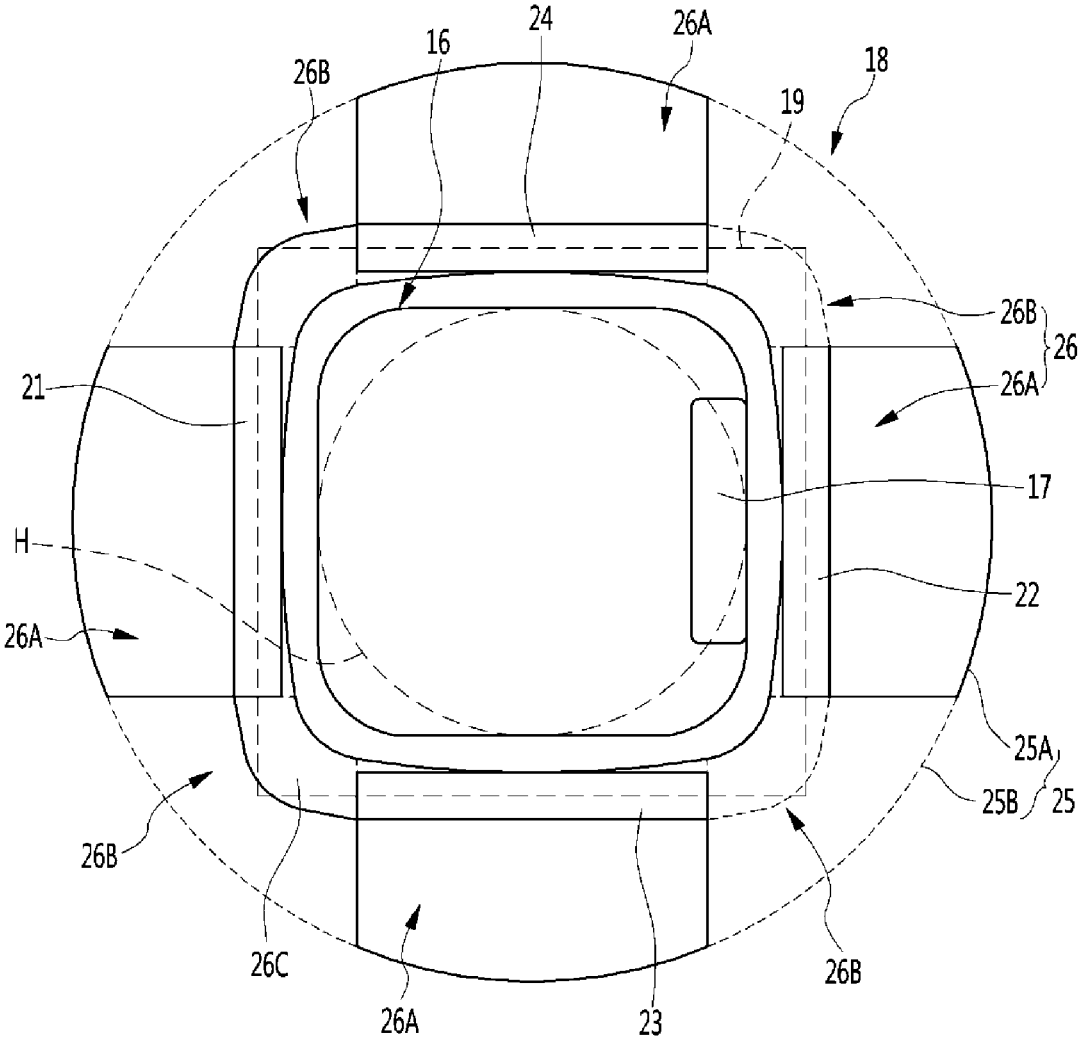
FIG. 8 is a plan view illustrating an intake flow path and a discharge flow path of a discharge panel according to an embodiment of the present disclosure.
Figure 9:
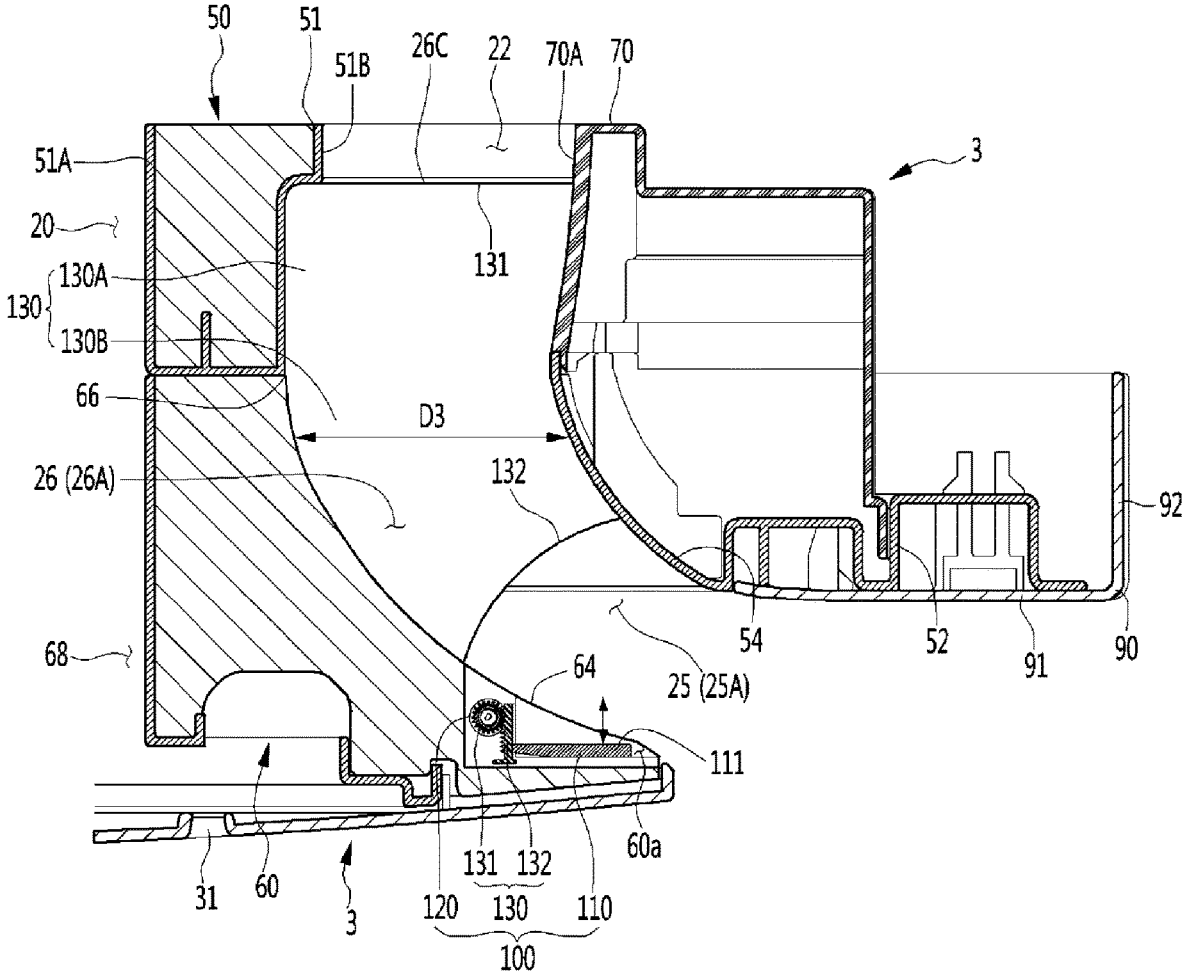
FIG. 9 is a cross-sectional view taken along line X-X' of FIG. 6.
Figure 10:
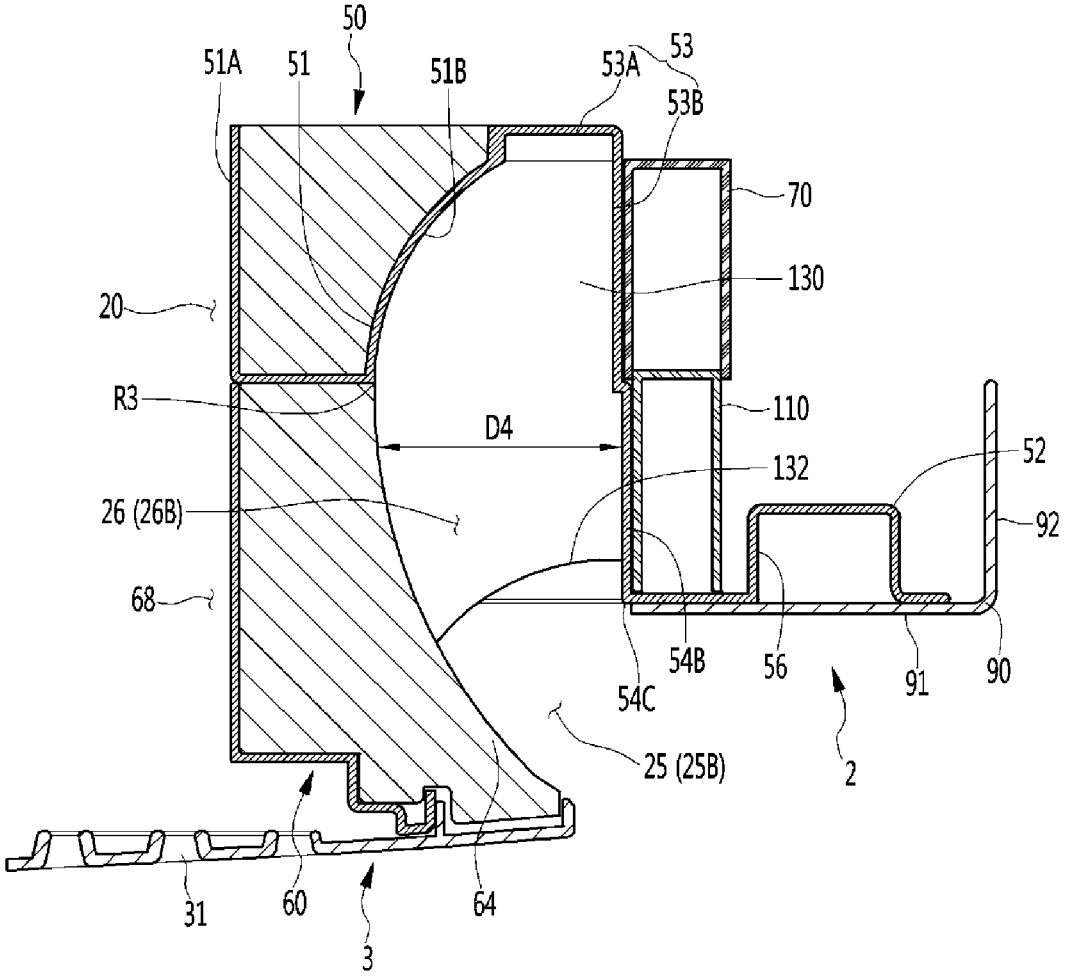
FIG. 10 is a cross-sectional view taken along line Y-Y' of FIG. 6.

FIG. 5 is a perspective view of a lower body assembly illustrated in FIGS. 1 to 3, FIG. 6 is a perspective view when a discharge panel and a suction panel are separated from the lower body assembly shown in FIG. 5, FIG. 7 is a perspective view illustrating a discharge flow path of a discharge panel according to an embodiment of the present disclosure, FIG. 8 is a plan view illustrating an intake flow path and a discharge flow path of a discharge panel according to an embodiment of the present disclosure, FIG. 9 is a cross-sectional view taken along line X-X' of FIG. 6, and FIG. 10 is a cross-sectional view taken along line Y-Y' of FIG. 6.

An intake flow path 16 may be provided at the discharge panel 2 to intake and guide the air passing through the intake panel 3 into the indoor unit 1. In addition, a discharge flow path 18 may be provided at the discharge panel 2 to guide and discharge air discharged from the plurality of blowing passages 7, 8, 9, and 10 into the room.

The discharge panel 2 may be provided with an intake flow path 16 may be formed to guide air passing through the intake panel 3 to the hollow portion 15 (see FIG. 3) of the indoor unit 1. The discharge panel 2 may have a hollow portion through which air passing through the intake panel 3 passes to be intaken into the indoor unit 1. The hollow portion of the discharge panel 2 may be formed to penetrate in an up-down direction at the center of the discharge panel 2. The hollow portion may be the intake flow path 16 of the discharge panel 2. Hereinafter, the intake flow path of the discharge panel 2 and the hollow portion of the discharge panel 2 will be described using the same reference numeral '16'.

As illustrated in FIG. 8, the intake flow path 16 may be located inside the discharge flow path 18 and may be formed to be distinguished from the discharge flow path 18.

The intake flow path 16 may have a circular or quadrangular cross-sectional shape. The quadrangular shape of the intake flow path 16 may include a quadrangular shape close to a circular shape. Here, the quadrangle close to the circle may refer to a quadrangle having two pairs of feces and four rounded vertices.

An intake flow path H having a circular cross-sectional shape is smaller in size than the intake flow path 16 having a quadrangular cross-sectional shape, and the intake flow path 16 having a quadrangular cross-sectional shape secures a larger intake area in the discharge panel 2, thereby helping intake air r quickly.

As shown in FIG. 5, the ceiling type air conditioner may accommodate an electrical component 17 such as a sensor, a motor, a printed circuit board (PCB), and the like in the intake flow path 16. In this case, the electrical component 17 may be disposed not to interfere with an air flow in the intake flow path 16 having a quadrangular shape or a shape close to the quadrangular shape as much as possible.

Meanwhile, when the electrical component 17 is quadrangular, the quadrangular electrical component 17 may not be easily mounted in the intake flow path H having a circular cross-sectional shape. In addition, an area in which the quadrangular electric component 17 blocks the circular intake flow path H may be too large and an intake amount of air through the circular intake flow path H may be reduced.

That is, the intake flow path 16 of the discharge panel 2 is preferably formed in a quadrangular cross-sectional shape or a shape as close to the rectangle as possible.

At least one inlet may be formed at the discharge panel 2. The discharge panel 2 may have a plurality of inlets 21, 22, 23, and 24 corresponding to the plurality of blowing passages 7, 8, 9, and 10. The discharge panel 2 may have an opening 25 having an arc shape or a circular shape. The discharge panel 2 may have an inner space 26 connecting the plurality of inlets 21, 22, 23, and 24, and the opening 25.

The discharge flow path 18 of the discharge panel 2 may include a plurality of inlets 21, 22, 23, and 24, a flow region 26A of the inner space 26, and a first opening region 25A of the opening 25.

The air discharged from the blowing passages 7, 8, 9, and 10 of the indoor unit 1 may flow into the flow region 26A through the plurality of inlets 21, 22, 23, and 24. The air passing through the flow region 26A may be discharged to the outside of the discharge panel 2 through the first opening region 25A.

The inlets 21, 22, 23, and 24 formed at the discharge panel 2 may correspond to the blowing passages 7, 8, 9, and 10 formed at the indoor unit 1 in a one-to-one manner.

The inlets 21, 22, 23, and 24 formed at the discharge panel 2 may include a left inlet 21 communicating with a left blowing passage 7 in an up-down direction, a right blowing passage 8 communicating with the right blowing passage 8 in the up-down direction, a front inlet 23 communicating with the front blowing passage 8 in the up-down direction, and a rear inlet 24 communicating with the rear blowing passage 10 in the up-down direction.

The left inlet 21 and the right inlet 22 may be spaced apart in the left-right direction with the hollow portion 16 formed in the discharge panel 2 interposed therebetween. The left inlet 21 and the right inlet 22 may extend in parallel with each other. Each of the left inlet 21 and the right inlet 22 may extend in the front-rear direction.

The front inlet 23 and the rear inlet 24 may be spaced apart from each other in the front-rear direction with the hollow portion 16 formed at the discharge panel 2 interposed therebetween. The front inlet 23 and the rear inlet 24 may extend in a direction parallel to each other. Each of the front inlet 23 and the rear inlet 24 may extend in the left-right direction.

A cross-sectional size of each of the plurality of inlets 21, 22, 23, and 24 may be equal to a cross-sectional size of each of the plurality of blowing passages 7, 8, 9, and 10.

A cross-sectional shape of each of the inlets 21, 22, 23, and 24 may be equal to a cross-sectional shape of each of the blowing passages 7, 8, 9, and 10.

The cross-sectional shape of the inlets 21, 22, 23, and 24 may be polygonal. Here, the polygonal shape of the inlets 21, 22, 23, and 24 may include a shape in which at least one vertex portion is rounded to have a predetermined curvature.

The cross-sectional shape of the inlets 21, 22, 23, and 24 may be quadrangular, in particular, rectangular, like the cross-sectional shape of the blowing passages 7, 8, 9, and 10. Here, the quadrangular shape of the inlets 21, 22, 23, and 24 may be a long longitudinal shape in the horizontal direction and may include a shape in which at least one side or at least one vertex is rounded.

The plurality of inlets 21, 22, 23, and 24 may be formed along a quadrangular virtual line 19 (see FIGS. 7 and 8) like the blowing passages 7, 8, 9, and 10 of the indoor unit 1 and the plurality of inlets 21, 22, 23, and 24 may be formed on the sides of the quadrangular virtual line 19, respectively.

The quadrangular virtual line 19 of the discharge panel 2 illustrated in FIGS. 7 and 8 and the quadrangular virtual line 17A of the indoor unit 1 illustrated in FIG. 4 have the same size and match in the up-down direction.

The opening 25 may be an air discharge port through which air which is air-conditioned in the ceiling type air conditioner is discharged to the outside of the ceiling type air conditioner. At least a portion of the opening 25 may discharge cold air heat-exchanged in the heat exchanger 5 of the indoor unit 1.

The number of the openings 25 may be smaller than the inlets 21, 22, 23, and 24. The opening 25 may be larger than each of the plurality of inlets 21, 22, 23, and 24.

The opening 25 may have an arc shape. In this case, a plurality of openings may be formed at the discharge panel 2. When the openings 25 have an arc shape, the plurality of openings 25 may be spaced apart from each other in a circumferential direction of the discharge panel 2 and may be formed along a circular virtual line. When the openings 25 have the arc shape, the arc shape may include a minor arc shape or a major arc shape such as a 'C' shape, or a semicircular shape.

The opening 25 may have a circular shape. In this case, one opening 25 may be formed in the discharge panel 2. In this case, when the opening 25 is circular, the circular shape may refer to an elliptic shape, and the cross-sectional shape may be formed in a closed loop shape.

The opening 25 may be an outlet through which air passing through the inner space 26 is discharged to the outside of the discharge panel 2.

The discharge panel 2, in a state of being coupled to the lower portion of the indoor unit 1, may be exposed to the room and the opening 25 may be exposed to the room together with the bottom surface of the discharge panel 2.

Referring to FIGS. 7 and 8, the opening 25 may include a first opening region 25A and a second opening region 25B.

The first opening region 25A may be a region corresponding to the inlets 21, 22, 23, and 24 of the opening 25. Specifically, the first opening region 25A may refer to a region located below the inlets 21, 22, 23, and 24 of the opening 25.

The second opening region 25B may be a region corresponding to between a pair of inlets adjacent to each other among the openings 25. Specifically, the second opening region 25B may refer to a region located below and between a pair of inlets adjacent to each other among the openings 25. The second opening region 25B may not correspond to the inlets 21, 22, 23, and 24 and may be located below a connecting portion 53 (to be described later).

That is, the first opening region 25A may correspond to the inlets 21, 22, 23, and 24 along the direction of the inner space 26, and the second opening region 25B may correspond to the connecting portion 53 along a direction of the inner space 26.

The first opening 25A and the second opening 25B may be alternately located along the circumferential direction of the discharge panel 2. When the openings 25 are circular, the first opening regions 25A and the second opening regions 25B may be alternately located along the circumferential direction of the opening 25.

The second opening region 25B may be located between a pair of first opening regions 25A adjacent to each other, and the first opening region 25A may be located between a pair of second opening regions 25B adjacent to each other.

Air flowing from the inlets 21, 22, 23, and 24 corresponding to first opening region 25A may be discharged from the first opening region 25A. Meanwhile, air may not be discharged from the second opening region 25B.

However, since a lower end 132 of a barrier 130 is formed to be concave upward, the first opening region 25A and the second opening region 25B may not be partitioned by the barrier 130. In this case, a portion of the air discharged to the first opening region 25A may be discharged from the second opening region 25B.

Each number of the first opening regions 25A and the second opening regions 25B may be equal to the number of the inlets 21, 22, 23, and 24.

Each of the first and second opening regions 25A and 25B may have an arc shape. When the opening 25 has a circular shape, each of the first opening region 25A and the second opening region 25B may have an arc shape forming a portion of the circular shape.

A circumferential length of the first opening 25A may be longer than a circumferential length of the second opening 25B. That is, an area of the first opening region 25A may be larger than an area of the second opening region 25B.

The inner space 26 may communicate with the inlets 21, 22, 23, and 24 and the opening 25. The inner space 26 may be located between the inlets 21, 22, 23, and 24 and the opening 25.

The flow region 26A of the inner space 26 may guide air introduced into the inlets 21, 22, 23, and 24 to the opening 25.

In the inner space 26, the flow region 26A may be an air flow change/discharge passage switching an air flow of the air intaken to the plurality of inlets 21, 22, 23, and 24 and guiding the air to the opening 25.

As shown in FIG. 9, an upper portion of the inner space 26 is formed between an outer circumferential surface 51B of the upper body portion 51 and an inner circumferential surface 70A of the outer cover 70.

A lower portion of the inner space 26 may be formed between an outer circumferential surface 65 of the inner flow path body 60 and an inner circumferential surface of the outer body portion 52. In this case, the outer circumferential surface of the inner flow path body 60 may be an inner curved surface 65 of an inner guide 64. In addition, the inner circumferential surface of the outer body portion 52 may be an outer curved surface 55 of the outer guide 54.

The inner space 26 may have a horizontal cross-section in a closed loop shape.

The inner space 26 may be formed in a shape in which the cross-sectional area gradually increases in a downward direction.

The inner space 26 may be formed to switch a vertical air flow to a horizontal air flow, and to this end, a vertical cross-sectional shape thereof may be a curved shape. The inner space 26 may have a shape in which the vertical cross-sectional shape opens in an outward direction toward the lower side.

Referring to FIGS. 7 and 8, a quadrangular imaginary line 19 in which the plurality of inlets 21, 22, 23, and 24 are located is not only higher than the opening 25 but also smaller than the opening 25. In this case, a first distance D1 between the side of the quadrangular virtual line 19 and the opening 25 may be different from a second distance D2 between the vertex of the quadrangular virtual line 19 and the opening 25.

The first distance D1 may be longer than the second distance D2, and the distance between the quadrangular virtual line 19 and the circular opening 25 may be increased and decreased along the circumferential direction. The first distance D1 may gradually decrease toward the vertex of the quadrangular virtual line 19.

The inner space 26 may be formed such that horizontal widths D3 and D4 are not equal in the circumferential direction in consideration of the difference between the distances D1 and D2.

The horizontal widths D3 and D4 of the inner space 26 may alternately increase and decrease along the opening 25 and may increase and decrease repeatedly.

The inner space 26 may include a flow region 26A and a blocking region 26B.

The flow region 26A may be formed below the inlets 21, 22, 23, and 24, and the blocking region 26B may be formed below the perimeter of the inlets 21, 22, 23, and 24 according to a position relation with the inlets 21, 22, 23, and 24.

The blocking region 26B may be located below a pair of inlets adjacent to each other.

The flow region 26A and the blocking region 26B may be partitioned by the barrier 130 (to be described later). The barrier 130 may be disposed between the flow region 26A and the blocking region 26B.

The flow region 26A may be located between a pair of barriers 130 facing each other.

The blocking region 26B may be located next to the flow region 26A in the horizontal direction.

The flow region 26A and the blocking region 26B may be alternately located along the circumferential direction of the discharge panel 2.

Referring to FIG. 9, the first opening region 25A may be located below the flow region 26A. Referring to FIG. 10, a second opening region 25B may be located below the blocking region 26B.

The flow region 26A may be located between the inlets 21, 22, 23, and 24, and the first opening region 25A. The blocking region 26B may be located between a portion between the pair of inlets adjacent to each other and the second opening region 25B. Specifically, the blocking region 26B may be located between the connecting portion 53 and the second opening region 25B.

Referring to FIGS. 7 and 8, the horizontal width D3 of the flow region 26A may be larger than the horizontal width D4 of the blocking region 26B. Here, the comparison between the horizontal widths D3 and D4 is made at the same height.

The horizontal width D3 of the flow region 26A may gradually decrease toward the blocking region 26B.

Referring to FIG. 7, the horizontal width D3 of the flow region 26A may increase and then decrease in a clockwise direction along the opening 25, and the horizontal width D4 of the blocking region 26B may decrease and then increase in the clockwise direction along the opening 25. In this case, an average of the horizontal width D3 of the flow region 26A may be larger than the average of the horizontal width D4 of the blocking region 26B.

An upper end 26C of the inner space 26 may be a region closer to the plurality of inlets 21, 22, 23, and 24, among the opening 25 and the plurality of inlets 21, 22, 23, and 24. A cross-sectional shape of the upper end 26C is generally formed in a quadrangular ring shape, and a vertex portion of the upper end 26C may be curved.

A lower end of the inner space 26 may be an opening 25 and a cross-sectional shape thereof may be a circular shape. Specifically, the lower end of the flow region 26A may be the first opening region 25A, and the cross-sectional shape thereof may be an arc shape. Further, a lower end of the blocking region 26B may be the second opening region 25B, and a cross-section thereof may have an arc shape.

In order for the internal shape 26 to correspond to the shape of the upper end 26C and the shape of the opening 25, the quadrangular ring shape may be gradually changed to the circular shape from the upper end 26C toward the opening 25.

The upper end 26C of the inner space 26 may include a region located below the inlets 21, 22, 23, and 24 and having a first curvature (hereinafter, referred to as a first curvature region 26D) and a region located below the perimeter of the polygonal inlets 21, 22, 23, and 24 and having a second curvature larger than the first curvature (hereinafter, referred to as a second curvature region 26E).

The second curvature region 26E may be a region extending in the horizontal direction from the first curvature region 26D. That is, the first curvature region 26D and the second curvature region 26E may be alternately located in the horizontal direction along the upper end 26C of the inner space 26.

In addition, the opening 25 may have a third curvature larger than the first curvature. The third curvature of the opening 25 may be equal to, smaller than, or larger than the second curvature.

The inner space 26 may have a cross-sectional shape gradually changed to a shape closer to a circular shape in the downward direction.

A portion of the inner space 26 located below the first curvature region 26D may have a shape in which the curvature gradually increases.

The portion of the inner space 26 located below the second curvature region 26E may have a shape in which the curvature is constant, gradually decreases, or gradually increases in the downward direction.

When the second curvature is equal to the third curvature, a portion of the inner space 26 located below the second curvature region 26E may have a constant curvature in the downward direction.

When the second curvature is larger than the third curvature, the portion of the inner space 26 located below the second curvature region 26E may gradually decrease in the downward direction.

When the ceiling type air conditioner, air passing through the plurality of inlets 21, 22, 23, and 24 may be dropped into the flow region 26A and may be discharged through the first opening region 25A.

Here, the air dropped into the flow region 26A may be blocked by the barrier 130 and may not flow to the blocking region 26B and may not be discharged to the second opening region 25B.

That is, in the present embodiment, the air flowing into the plurality of inlets 21, 22, 23, and 24 does not spread in the horizontal direction in the inner space 26 and may be discharged to the first opening region 25A of the opening 25, and the ceiling type air conditioner may discharge air which is air-conditioned to a portion of the opening 25.

The ceiling type air conditioner according to an embodiment of the present disclosure may include a barrier 130. The barrier 130 may be disposed in the inner space 26A of the discharge panel 2.

An upper end 131 of the barrier 130 may be located below the inlets 21, 22, 23, and 24 and a lower end 132 may be located above the opening 25. However, the present disclosure is not limited thereto, and the upper end of the barrier 130 may be located at the inlets 21, 22, 23, and 24 and the lower end 131 may be located at the opening 25.

The upper end 131 of the barrier 130 may be formed at the same height as the upper end 26C of the inner space 26. The lower end 132 of the barrier may be located before the opening 25 along an air flow direction.

The barrier 130 may partition the inner space 26 into the flow region 26A and the blocking region 26B. The barrier 130 may be disposed between the flow region 26A and the blocking region 26B.

At least one barrier 130 may be provided. Preferably, the number of barriers 130 may be twice the number of inlets 21, 22, 23, and 24. That is, a pair of barriers 130 may correspond to one inlet. For example, four inlets 21, 22, 23, and 24 may be formed at the discharge panel 2 and eight barriers 130 may be provided.

The barrier 130 may be disposed perpendicular to the inner space 26.

The lower end 131 of the barrier 130 may be concave. Specifically, the lower end 131 of the barrier 130 may be formed concave upward. As a result, the lower end 131 of the barrier 130 may be prevented from being exposed to the outside of the discharge panel 2 and the ceiling type air conditioner may be improved in terms of design.

At least a portion of the barrier 130 may be located between the inner flow path body 60 and the outer body portion 52. The barrier 130 may be in contact with the inner curved surface 65 which is the outer circumferential surface of the inner flow path body 60.

The barrier 130 may include an upper region 130A located between the upper body portion 51 and the outer cover 70 and a lower region 130B located between the inner flow path body 60 and the outer body portion 52.

An inner end of the upper region 130A may be in contact with the outer circumferential surface of the upper body portion 51, and the outer end may be in contact with an inner circumferential surface 70A of the outer cover 70. An inner end of the lower region may be in contact with the outer circumferential surface of the inner flow path body 60 and an outer end may be in contact with the inner circumferential surface of the outer body portion 52.

Figure 11:
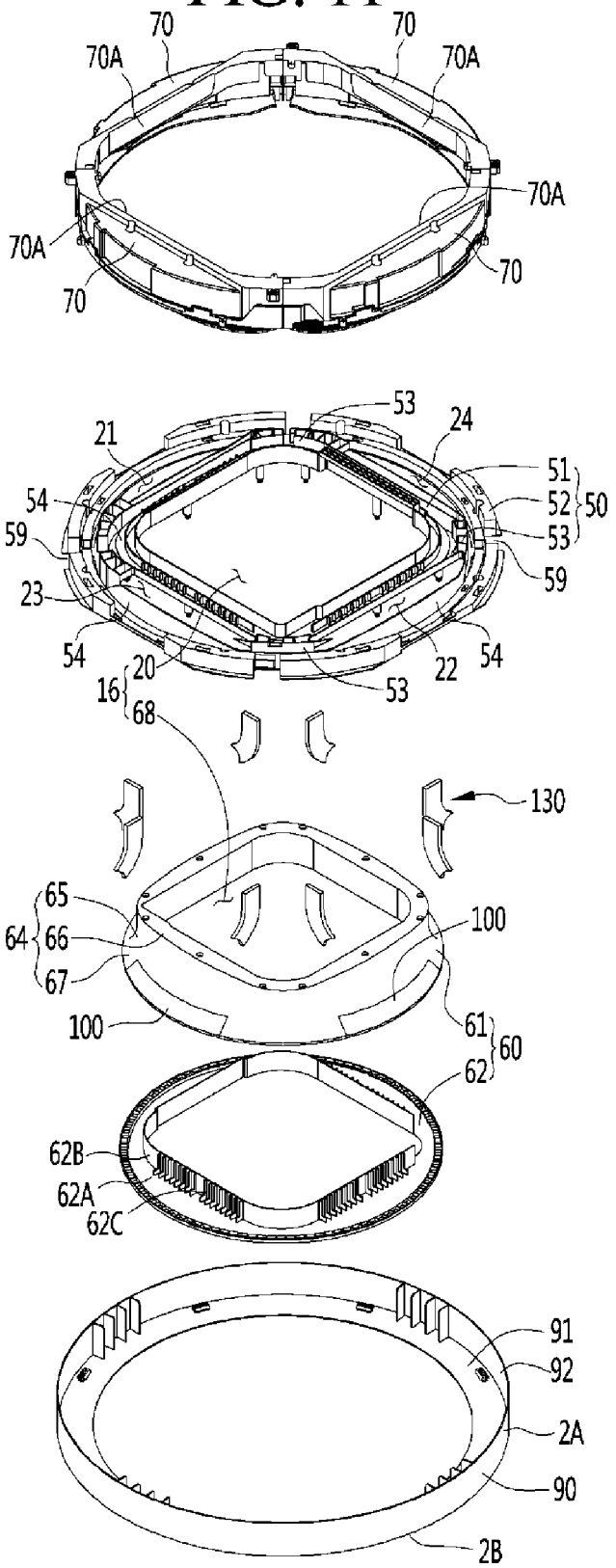
FIG. 11 is an exploded perspective view of a discharge panel according to an embodiment of the present disclosure.
Figure 12:
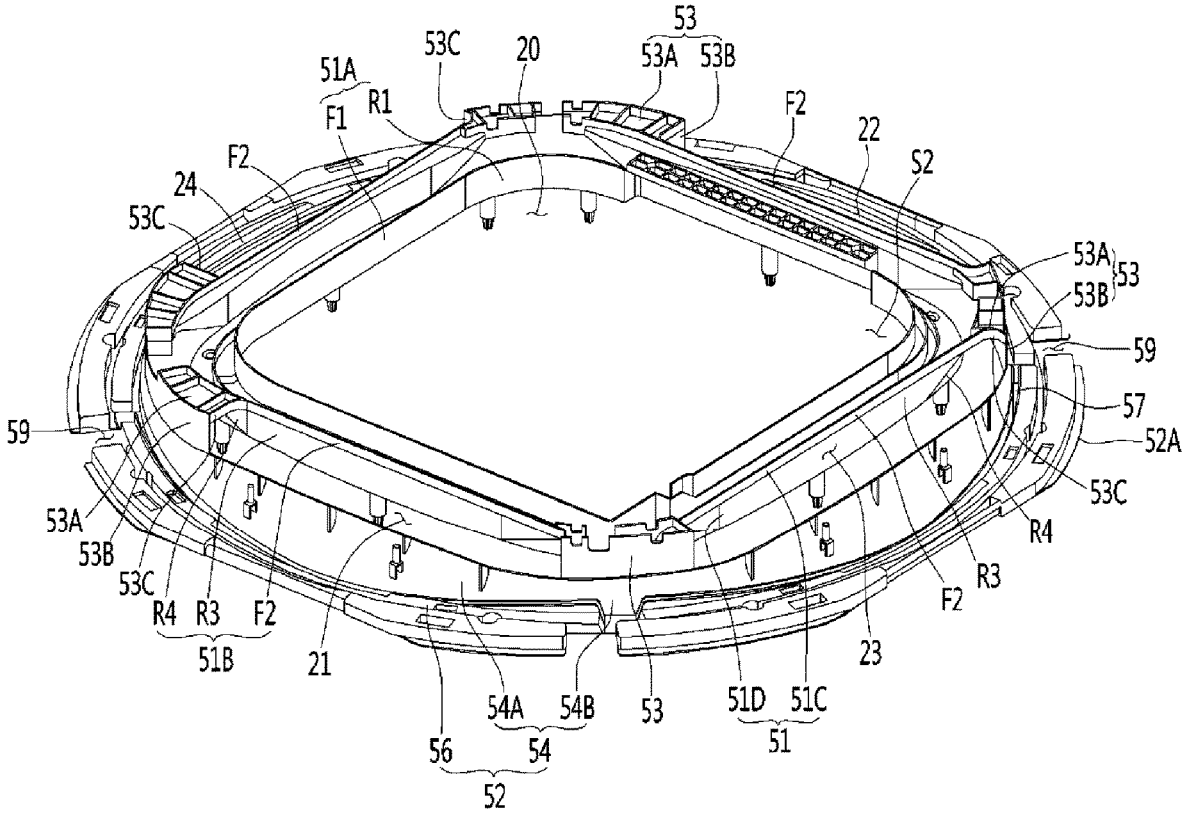
FIG. 12 is a perspective view illustrating a main flow path body according to an embodiment of the present disclosure.
Figure 13:
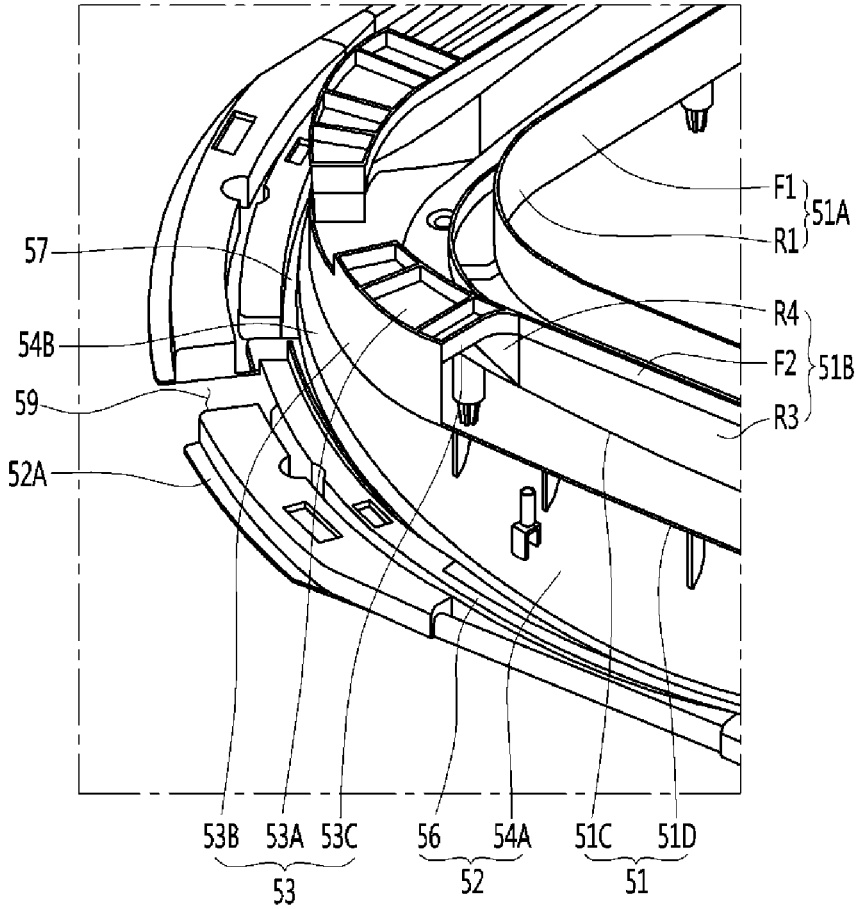
FIG. 13 is an enlarged perspective view of a portion of a main flow path body according to an embodiment of the present disclosure.
Figure 14:
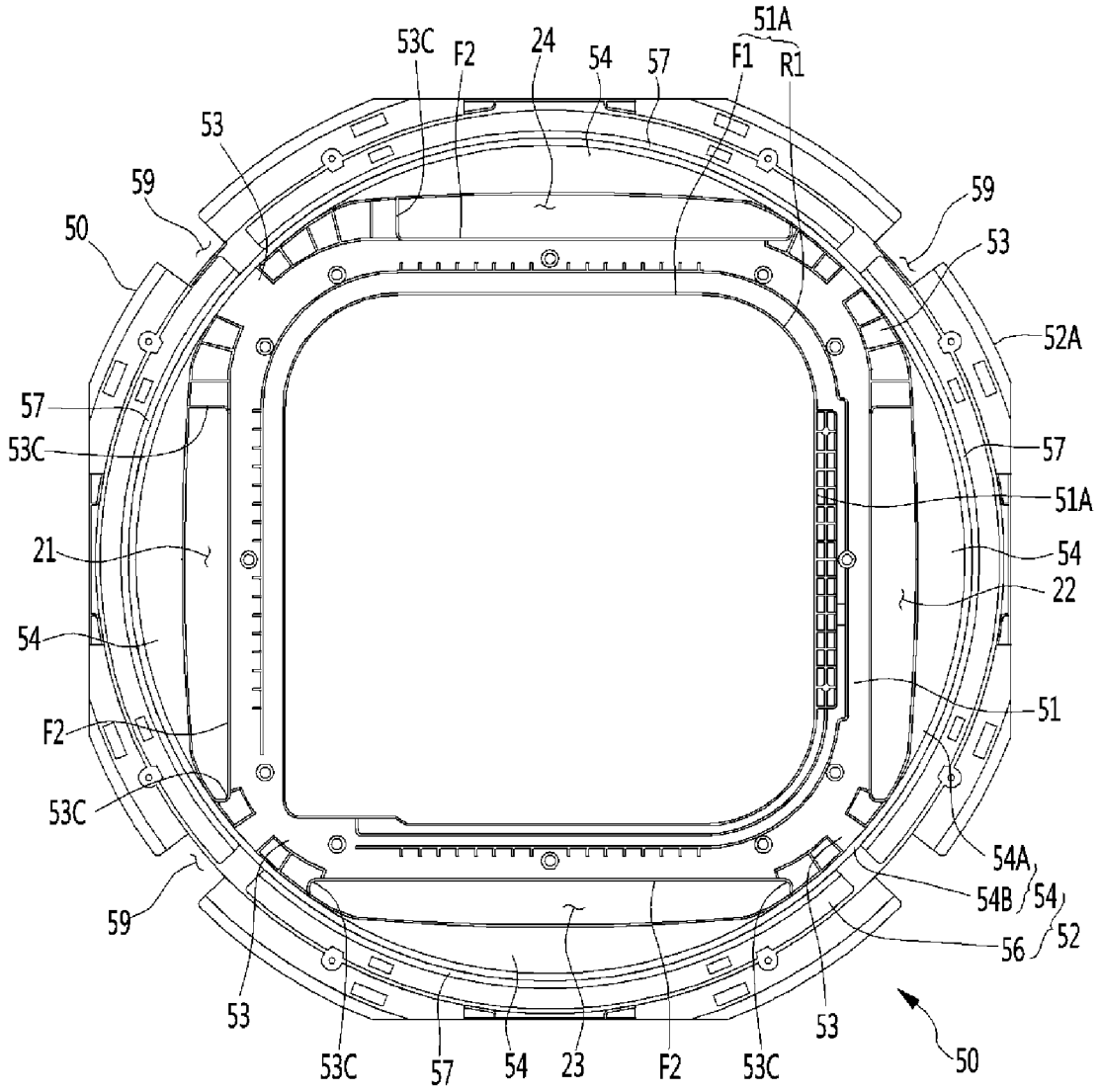
FIG. 14 is a plan view of a main flow path body according to an embodiment of the present disclosure.
Figure 15:
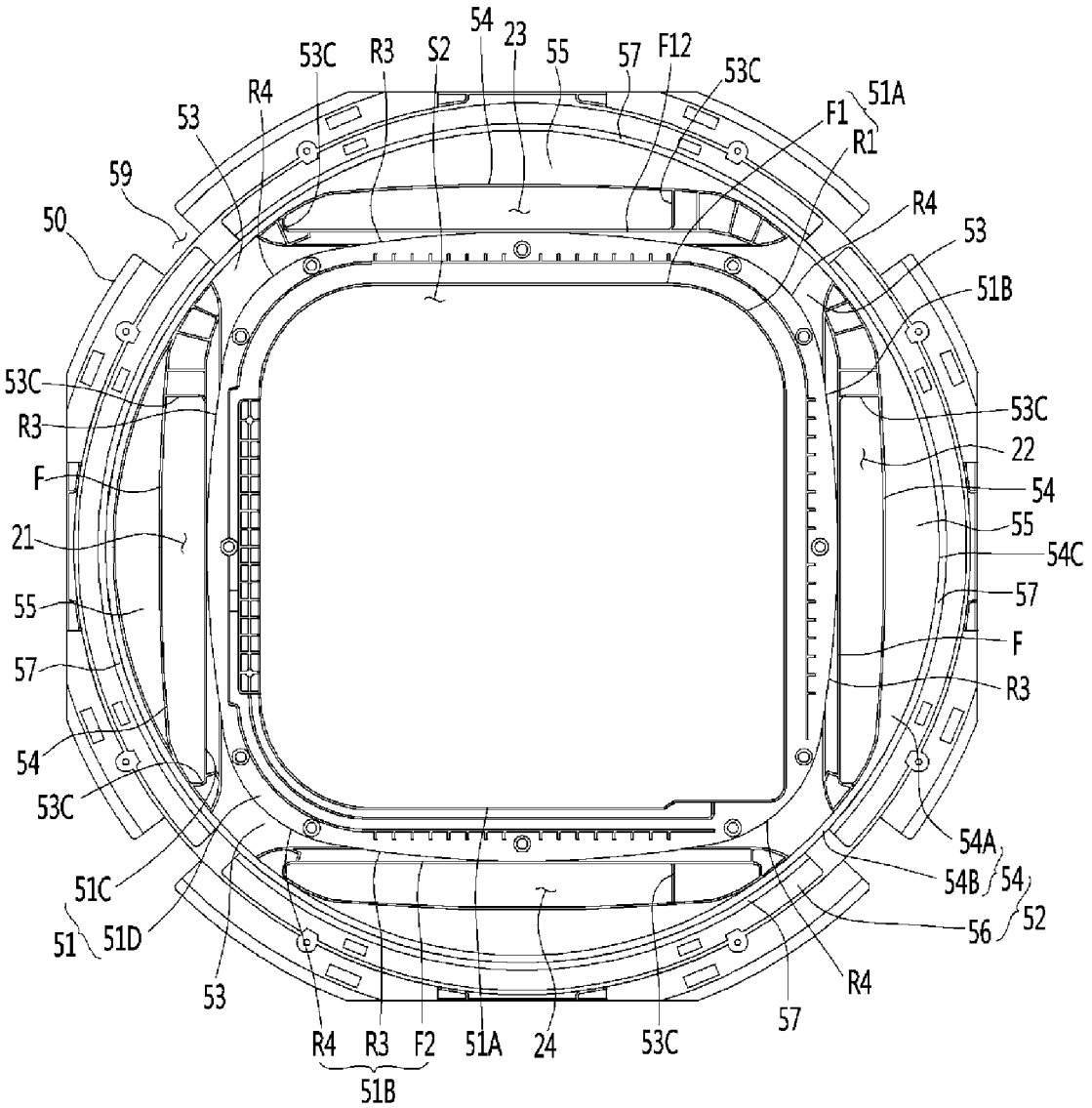
FIG. 15 is a bottom view of a main flow path body according to an embodiment of the present disclosure.
Figure 16:
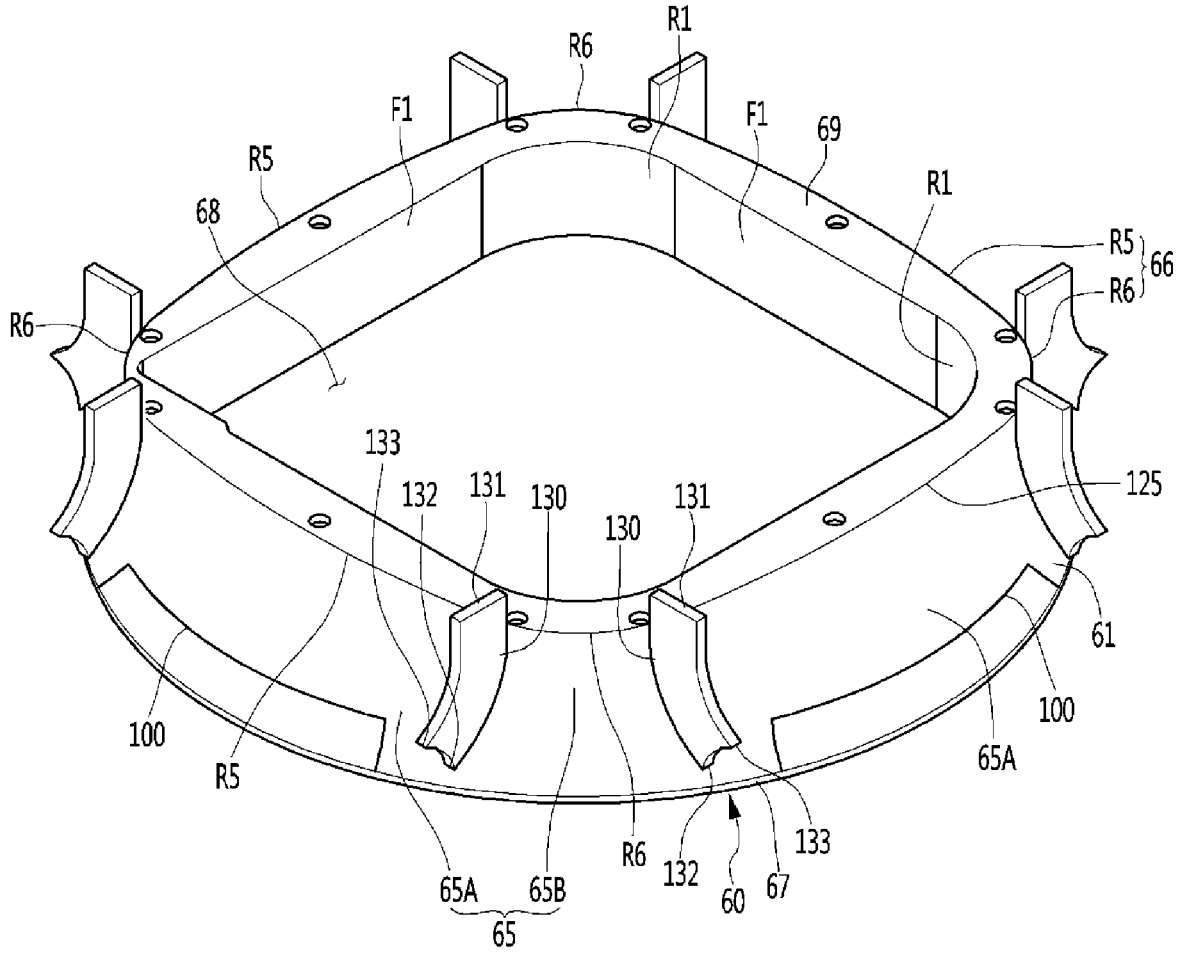
FIG. 16 is a perspective view of an inner flow path body and a barrier according to an embodiment of the present disclosure.
Figure 17:
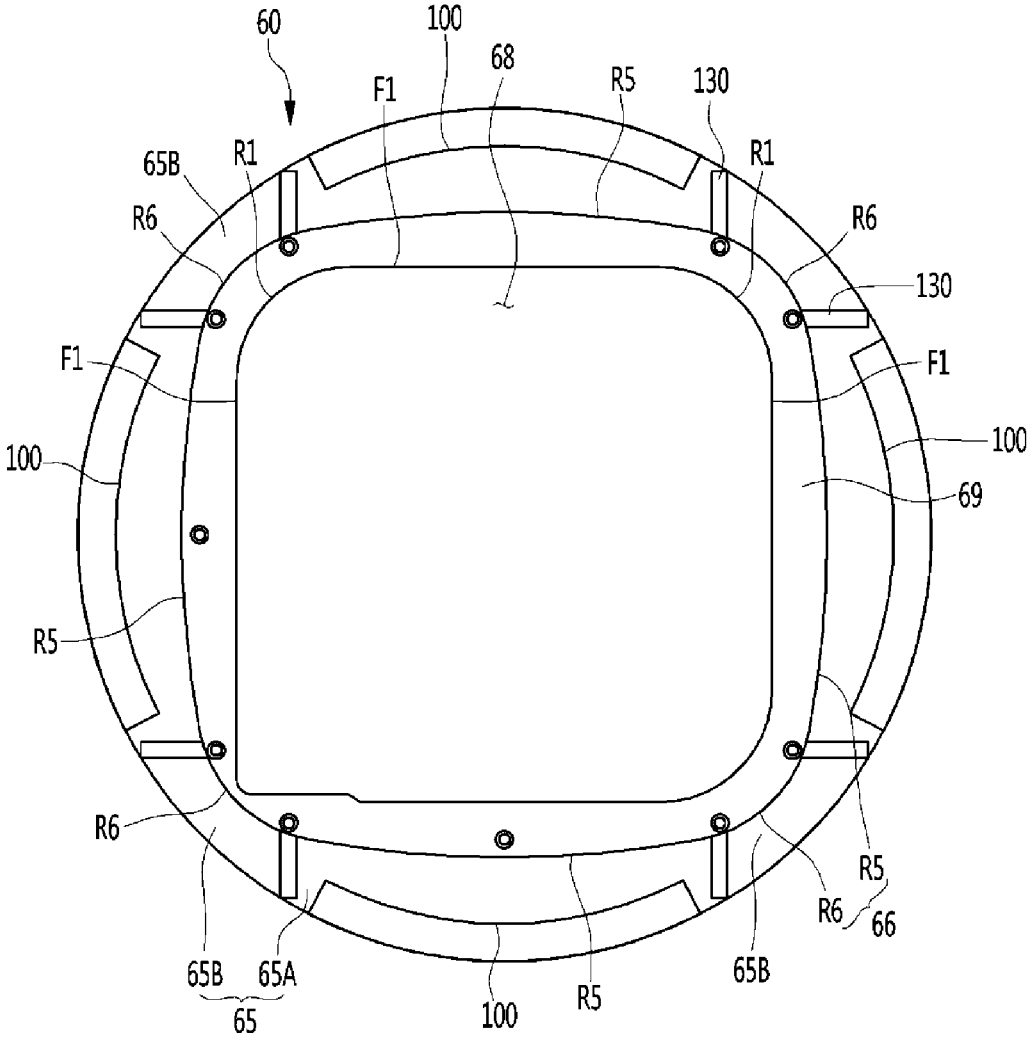
FIG. 17 is a plan view of an inner flow path body and a barrier according to an embodiment of the present disclosure.

FIG. 11 is an exploded perspective view of a discharge panel according to an embodiment of the present disclosure, FIG. 12 is a perspective view illustrating a main flow path body according to an embodiment of the present disclosure, FIG. 13 is an enlarged perspective view of a portion of a main flow path body according to an embodiment of the present disclosure, FIG. 14 is a plan view of a main flow path body according to an embodiment of the present disclosure, FIG. 15 is a bottom view of a main flow path body according to an embodiment of the present disclosure, FIG. 16 is a perspective view of an inner flow path body and a barrier according to an embodiment of the present disclosure, and FIG. 17 is a plan view of an inner flow path body and a barrier according to an embodiment of the present disclosure.

The discharge panel 2 may include a main flow path body 50 and an inner flow path body 60 coupled to the main flow path body 50.

The discharge panel 2 may further include an outer cover 70 guiding the air passing through the blowing passages 7, 8, 9, and 10 to the flow region 26A of the inner space 26. The discharge panel 2 may further include a decor cover 90 coupled to the main flow path body 50.

The discharge panel 2 may allow air to flow between the pair of guides 54 and 64 spaced apart from each other. The air may be discharged and guided in a direction guided by the pair of guides 54 and 64.

One of the pair of guides 54 and 64 may be formed at the main flow path body 50, and the other of the pair of guides 54 and 64 may be formed at the inner flow path body 60.

The pair of guides 54 and 64 may include an outer guide 54 located relatively outside and an inner guide 64 provided inside the outer guide 54 and spaced apart from the outer guide 54.

The outer guide 54 may be formed at the main flow path body 50. The outer guide 54 may be formed on an inner circumferential surface of the main flow path body 50.

In addition, the inner guide 64 may be formed at the inner flow path body 60. The inner guide 64 may be formed on an outer circumferential surface of the inner flow path body 60.

The inner space 26 may be formed between the inner guide 64 and the outer guide 54. The flow region 26A of the inner space 26 may guide the air flowing into the inlets 21, 22, 23, and 24 to the opening 25.

The discharge panel 2 may have a hollow portion 16 formed to penetrate therethrough and opened in an up-down direction, and the hollow portion 16 may have a flat surface F1 and a curved surface R1 alternately formed along an inner circumference of the discharge panel 2.

In the hollow portion 16, a pair of flat surfaces F1 perpendicular to each other may be connected by the curved surface R1, and a pair of curved surfaces R1 may be connected by the flat surface F1. The hollow portion 16 may be formed by four flat surfaces F1 and four curved surfaces R1.

The hollow portion 16 may be formed at each of the main flow path body 50 and the inner flow path body 60. An upper hollow portion 20 formed at the main flow path body 50 and a lower hollow portion 68 formed at the inner flow path body 60 may communicate with each other in an up-down direction.

The upper hollow portion 20 and the lower hollow portion 68 may have the same shape and include a flat surface F1 and a curved surface R1 as shown in FIGS. 14 to 16.

The upper hollow portion 20 penetrated in the up-down direction may be formed at the main flow path body 50. The upper hollow portion 20 may serve as an intake flow path 16 through which air passing through the intake panel 3 is intaken into the indoor unit 1. The upper hollow portion 20 may be located above the intake panel 3 and may be located below the inner intake 6 of the indoor unit 1.

The main flow path body 50 may have an opening forming a plurality of inlets 21, 22, 23, and 24 between the outer circumference and the upper hollow portion 20.

The main flow path body 50 may be formed larger than the indoor unit 1 and may cover the indoor unit 1 from a lower side of the indoor unit 1. The main flow path body 50 may include a region facing the indoor unit 1 in the up-down direction and a region facing the perimeter of the indoor unit 1 in the up-down direction.

The main flow path 50 may have a service hole 59 facing the fastening portion 12 for fastening the indoor unit 1 to the ceiling. The service hole 59 may be formed at the main flow path body 50 as many as the number of fastening portions 12. The service hole 59 may be an opening formed to open in the up-down direction. The service hole 59 may be open on a side surface. The discharge panel 2 may further include a deco cover 90 covering the service hole 59. The deco cover 90 may form an outer edge of the discharge panel 2.

The main flow path body 50 may include an upper body portion 51, an outer body portion 52, and a connecting portion 53.

The upper body portion 51 may be formed such that the upper hollow portion 20 penetrates in the up-down direction at the center thereof. The upper body portion 51 may be connected to the outer body portion 52 larger than the upper body portion 52 by the connecting portion 53.

The outer body portion 52 may be larger than the upper body portion 51. A height of the outer body portion 52 may be lower than a height of the upper body portion 51.

The connecting portion 53 may connect the upper body portion 51 and the outer body portion 52 having different heights and sizes.

The upper body portion 51 may be formed in a closed loop cross-sectional shape. An inner circumferential surface 51A of the upper body portion 51 may form the upper hollow portion 20.

The upper hollow portion 20 may have a quadrangular cross-sectional shape and four vertex portions thereof may be rounded. The inner circumferential surface 51A of the upper body portion 51 may have a flat surface F1 and a curved surface R1 alternately formed along the inner circumferential surface.

The upper body portion 51 may form an upper portion of the inner space 26 together with the outer cover 70.

The upper body portion 51 may form polygonal inlets 21, 22, 23, and 24, and a portion located below the polygonal inlets 21, 22, 23, and 24 may configure an upper portion of the inner space 26 may be configured together with the outer cover 70.

An outer circumferential surface 51B of the upper body portion 51 may form the polygonal inlets 21, 22, 23, and 24 together with the connecting portion 53 and the outer cover 70. The polygonal inlets 21, 22, 23, and 24 may be formed between the upper body portion 51, the connecting portion 53, and the outer cover 70.

The outer circumferential surface 51B of the upper body portion 51 may be spaced apart from one surface 70A of the outer cover 70. The polygonal inlets 21, 22, 23, and 24 may be formed to penetrate in the up-down direction between the outer circumferential surface 51B of the upper body portion 51 and one surface 70A of the outer cover 70.

The upper body portion 51 may have a quadrangular shape and four vertex portions thereof may be rounded.

The outer circumferential surface of the upper body portion 51 may include an upper flat surface F2 and lower curved surfaces R3 and R4 lower than the upper flat surface F2. The outer cover 70 may have one surface 70A facing the upper flat surface F2 and the lower curved surfaces R3 and R4 in the horizontal direction.

The upper flat surface F2, together with the connecting portion 53 and the outer cover 70, may form the polygonal inlets 21, 22, 23, and 24.

The lower curved surfaces R3 and R4 may form an upper portion of the inner space 26 together with the outer cover 70.

The upper body portion 51 may include an upper guide 51C where the upper flat surface F2 is formed and a lower guide 51D where lower curved surfaces R3 and R4 are formed along the outer circumferential surface.

The upper flat surface F2 may be a flat surface elongated in the horizontal direction and may face one surface 70A of the outer cover 70 in the horizontal direction.

The polygonal inlets 21, 22, 23 and 24 may be formed to have a substantially rectangular shape between the upper flat surface F2, a side end 53C of the connecting portion 53, and one surface 70A of the outer cover 70.

The lower curved surfaces R3 and R4 may be curved surfaces having a curvature close to a flat surface. Air passing through the polygonal inlets 21, 22, 23, and 24 may be guided to the lower curved surfaces R3 and R4.

The lower curved surfaces R3 and R4 may include a region R3 (hereinafter referred to as a third region) facing one surface 70A of the outer cover 70 in the horizontal direction and a region R4 (hereinafter referred to as a fourth region) facing the connecting portion 53 in the horizontal direction.

A region between the third region R3 and one surface 70A of the outer cover 70 may be a region to which air passing through the polygonal inlets 21, 22, 23, and 24 flows.

A region between the fourth region R4 and the connecting portion 53 may be a space in which air intaken through the polygonal inlets adjacent to each other is mixed.

The third region R3 and the fourth region R4 may have different curvatures.

The third region R3 may be a curved surface close to a flat surface, and a curvature of the third region R3 may be smaller than a curvature of the fourth region R4.

The fourth region R4 may be more curved than the third region R3.

An empty space may be formed in a radial direction of the discharge panel 2 between the lower curved surfaces R3 and R4 of the upper body portion 51 and one surface 70A of the outer cover 70. A horizontal width of the empty space may increase and decrease in the circumferential direction of the discharge panel 2.

The main flow path 50 may include an outer guide 54 spaced apart from the inner guide 64. The outer guide 54 may include an outer curved surface 55 which is convex toward the inner guide 64. The outer guide 54 may be part of the outer body portion 52.

The outer body portion 52 may include a mounting portion 56 formed in a ring shape and an outer guide 54 formed on an inner circumference of the mounting portion 56.

The mounting portion 56 may be formed in an annular plate shape. The outer cover 70 and the decor cover 90 may be mounted on the mounting portion 56.

The outer guide 54 may face the outer circumferential surface of the inner flow path body 60. The outer guide 54 may have an outer curved surface 55 convex toward the inner flow path body 60.

The outer guide 54 may include a guide portion 54A having the outer curved surface 55 convex toward the inner flow path body 60. The outer guide 54 may further include a guide connecting portion 54B connected to a side connecting portion 53B (to be described later).

The guide portion 54A and the guide connecting portion 54B may be alternately located along the outer guide 54.

The guide portion 54A may be an expansion portion which gradually expands downward.

The outer curved surface 55 may be a surface facing the outer circumferential surface of the inner flow path body 60 of the guide portion 54A.

The guide connecting portion 54B may be a non-expansion portion having a constant size in the up-down direction.

An upper portion of the connecting portion 53 may be connected to the upper body portion 51, and a lower portion thereof may be connected to the outer body portion 52.

The upper portion of the connecting portion 53 may be connected to the outer circumference of the upper body portion 51, and the lower portion thereof may be connected to the upper end of the outer body portion 52. A lower portion of the connecting portion 53 may be connected to the upper end of the outer guide 54.

The connecting portion 53 may include an upper connecting portion 53A and a side connecting portion 53B.

The upper connecting portion 53A may extend horizontally from an upper outer circumference of the upper body portion 51. The upper connecting portion 53A may be perpendicular to the side connecting portion 53B.

The upper connecting portion 53A may face the outer circumferential surface of the inner flow path body 60 in the up-down direction.

The upper connecting portion 53A may have a side end 53C perpendicular to the upper flat surface F2, and the polygonal inlets 21, 22, and 23, and the polygonal inlets 21, 22, and 23 may have a polygonal shape by the upper flat surface F2 of the upper body portion 51, the side end 53C of the upper connecting portion 53A, and one surface 70A of the outer cover 70.

The side connecting portion 53B may extend in the downward direction from the upper connecting portion 53A and be connected to the outer body portion 52. The side connecting portion 53B may be connected to the upper portion of the outer body portion 52.

The side connecting portion 53B may extend in the vertical direction and face the fourth region R4 formed on the outer circumferential surface 51B of the upper body portion 51 in the horizontal direction.

A plurality of connecting portions 53 may be formed between the upper body portion 51 and the outer body portion 52. The plurality of connecting portions 53 may be formed to be spaced apart from each other. The number of connecting portions 53 may be equal to the number of inlets 21, 22, 23, and 24. The discharge panel 2 may have an inlet formed between a pair of adjacent connecting portions 53.

The barrier 130 may be disposed to be in contact with the connecting portion 53. Specifically, the barrier 130 may be in contact with the upper connecting portion 53A and the side connecting portion 53B.

The barrier 130 may be in contact with the side end 53C of the connecting portion 53. Alternatively, the barrier 130 may be disposed to be in contact with a bottom surface of the connecting portion 53.

The pair of barriers 130 may be disposed to be in contact with both side ends 53C of the connecting portion 53, respectively.

The main flow path body 50 may have a space S2 having an open bottom surface therein. The main flow path body 50 may have the space S2 having an open bottom surface inside the outer guide 54. The space S2 of the main flow path body 50 may be larger than the outer circumference of the upper hollow portion 20. The space S2 of the main flow path body 50 may be an empty space surrounded by the connecting portion 53 and the outer guide 54.

A receiving space 60*a* accommodating the air guide module 100 may be formed at the discharge panel 2. The receiving space 60*a* may be formed near the opening 25.

The outer body portion 52 may form a lower portion of the inner flow path body 60 and the inner space 26.

A lower end of the outer body portion 52 may form the opening 25 with a lower end of the outer circumferential surface of the inner flow path body 60.

The inner flow path body 60 may be disposed below the upper body portion 51.

The inner flow path body 60 may be coupled to the perimeter of the upper hollow portion 20 to form the inner space 26 and the opening 25 with the main flow path body 50. The opening 25 and the inner space 26 may be formed between the inner flow path body 60 and the outer body portion 52.

An inner flow path body 60 may have an upper surface 69 coupled to a perimeter of the upper hollow portion 20.

The upper surface 69 of the inner flow path body 60 may be in contact with a lower surface of the upper body portion 51.

The inner flow path body 60 may be formed to gradually expand downward.

The inner passage body 60 may have a lower hollow portion 68 through which air passes, in the up-down direction. The lower hollow portion 68 may serve as the intake flow path 16 through which air passing through the intake panel 3 is intaken into the indoor unit 1.

When the blower 4 is driven, air passing through the lower hollow portion 68 of the inner flow path body 60 may be intaken to the indoor unit 1 through the upper hollow portion 20 of the main flow path body 50.

The outer cover 70 may be coupled to the main flow path body 50 and form the inlets 21, 22, 23, and 24 together with the main flow path body 50.

The outer circumferential surface of the inner flow path body 60 may include an inlet facing surface 65A facing the polygonal inlets 21, 22, 23, and 24 in the up-down direction and a connecting portion facing surface 65B facing the connecting portion 53 in the up-down direction.

The inlet facing surface 65A and the connecting portion facing surface 65B may be alternately formed along the outer circumferential surface of the inner flow path body 60.

The inlet facing surface 65A may be gentler than the connecting portion facing surface 65A.

The inlet facing surface 65A may form the flow region 26A together with the guide portion 54A of the outer guide 54, and the connecting portion facing surface 65A may form the blocking region 26B together with the guide connecting portion of the outer guide 54.

The upper surface 69 of the inner flow path body 60 is formed in a quadrangular ring shape as a whole and a vertex portion thereof may be curved.

The outer circumference of the upper surface 69 of the inner flow path body 60 may include a fifth region R5 having the same curvature as the third region R3 and a sixth region R6 having the same curvature as the fourth region R4. The fifth region R5 and the sixth region R6 may be alternately located along the outer circumference of the inner flow path body 60.

A lower end 67 of the inner flow path body 60 may have a circular shape.

The outer circumferential surface 65 of the inner flow path body 60 may be changed from the quadrangular ring-shape gradually to a circular shape toward the lower end 67 of the inner flow path body 60 from the outer circumference of the upper surface of the inner flow path body 60 to correspond to the upper outer circumference shape of the inner flow path body 60 and the shape of the lower end 67 of the inner flow path body 60.

The barrier 130 may be disposed to be in contact with the outer circumferential surface of the inner flow path body 60.

The barrier 130 may be disposed between the inlet facing surface 65A and the connecting portion facing surface 65B of the outer circumferential surface of the inner flow path body 60. The barrier 130 may be disposed at a boundary between the inlet facing surface 65A and the connecting portion facing surface 65B.

The inner end of the barrier 130 may have a shape outwardly bent downward along the outer circumferential surface of the inner flow path body 60.

The lower end 132 of the barrier 130 may be spaced apart from the lower end 67 of the inner flow path body 60. The lower end 132 of the barrier 130 may be located above the lower end 67 of the inner flow path body 60.

The upper end 131 of the barrier 130 may be located above the upper surface 69 of the inner flow path body 60.

The barrier 130 may be provided in plurality, and each barrier may be spaced apart from each other. The barrier 130 may be disposed along the outer circumferential surface of the inner flow path body 60.

The inner flow path body 60 may have an upper portion inserted into and accommodated in the space S2 of the main flow path body 50 and a lower end thereof may be lower than the main flow path body 50.

The inner flow path body 60 may be formed to gradually expand downward. An upper end of the inner guide 64 may face the outer guide 54 in the horizontal direction. A lower end of the inner guide 64 may face the outer guide 54 in the up-down direction.

The inner flow path body 60 may have an inner guide 64 formed on an outer circumferential surface thereof. An inner curved surface 65 may be formed at an outer circumference of the inner flow path body 60. The inner guide 64 may include an inner curved surface 65. The outer circumferential surface of the inner guide 64 may be an inner curved surface 65. Hereinafter, the outer circumferential surface and the inner curved surface of the inner guide 64 will be described using the same reference numeral '65'.

The inner guide 64 may include a concave recessed inner curved surface 65. The inner curved surface 65 may have an upper end 66 facing the outer curved surface 55 in the horizontal direction. The upper end 66 of the inner curved surface 65 may be the outer circumference of the upper surface 69 of the inner flow path body 60. A lower end 67 of the inner curved surface 65 may face the outer curved surface 55 in the up-down direction.

A lower portion of the inner space 26 may be formed between the inner guide 64 and the outer guide 54.

The opening 25 may be formed between the lower outer circumference of the inner guide 64 and the outer guide 54.

The inner flow path body 60 may include an outlet end 67 spaced apart from the outer guide 54 in the up-down direction. The outlet end 67 may be the same as the lower end 67 of the inner curved surface 65. Hereinafter, the lower end of the inner curved surface 65 and the outlet end will be described using the same reference numeral '67'.

The outlet end 67 may form the opening 25 together with the outer guide 54. That is, the opening 25 may be formed between the outlet end 67 and the outer guide 54.

The outlet end 67 of the inner flow path body 60 may be a lower outer circumference of the inner guide 64. The lower end of the inner guide 64 may be a lower outer circumference of the inner guide 64, and the outlet end 67 of the inner flow path body 60 may be a lower end of the inner guide 64.

Inner flow path body 60 may include a combination of a plurality of members.

The inner flow path body 60 may include a flow path forming body disposed such that at least a portion of an outer circumferential surface thereof faces the main flow path body 50 to form the opening 25 and the inner space 26 with the main flow path body 50 and a strength reinforcing body 62 coupled to the flow path forming body 61.

The flow path forming body 61 may have an upper end coupled to a lower portion of the upper body portion 51. The flow path forming body 61 may have a hollow portion which is open in the up-down direction therein. An outer circumference of the flow path forming body 61 may be the inner guide 64.

The strength reinforcing body 62 may include a lower reinforcing body 62A coupled to a lower surface of the flow path forming body 61 and an upper reinforcing body 62B protruding in an upward direction from an inner circumference of the lower reinforcing body 62A and inserted into a hollow portion of the flow path forming body 61. The strength reinforcing body 62 may include a strength reinforcing rib 62C protruding from the upper reinforcing body 62. The strength reinforcing rib 62C may be inserted into a fitting slot formed on an inner circumferential surface of the flow path forming body 61 and may be coupled to the flow path forming body 61.

The outer cover 70 may be mounted to be spaced apart from the upper body portion 51. The outer cover 70 may be disposed on the outer body portion 52.

At least one outer cover 70 may be disposed at an upper portion of the outer body portion 52.

The outer cover 70 may be seated on the guide portion 54A and guide air flowing into the polygonal inlets 21, 22, 23, and 24 to the guide portion 54A. The air flowing into the polygonal inlets may be guided to the guide portion 54A along one surface 70A of the outer cover 70, and the air may flow to the opening 25 along the outer curved surface 55 of the guide portion 54A.

An upper portion of the one surface 70A of the outer cover 70 may form an inlet, and such an upper portion of the one surface 70A may be a flat surface instead of a curved surface.

The outer cover 70 may include an upper cover portion 71, a flow path body portion 72 extending in the downward direction from the upper cover portion 71, and a side cover portion 73 extending in the downward direction from the upper cover portion 71.

The flow path body portion 72 may form the inlets 21, 22, 23, and 24 with the main flow path body 50. The flow path body portion 72 may be disposed at the outer guide 54 and spaced apart from the upper body portion 51. The flow path body portion 72 may face an outer surface of the upper body portion 51, and the inlets 21, 22, 23, and 24 may be formed between the outer surface of the upper body portion 51 and the flow path body portion 72.

The number of the outer covers 70 may be equal to the number of the inlets 21, 22, 23, and 24.

The flow path body portion 72 may form an upper portion of the inner space 26 together with the upper body portion 51 and the connecting portion 53. The flow path body portion 72 may have a lower end in contact with the upper end of the outer guide 54. The lower end of the flow path body portion 72 may be seated on and supported by the upper end of the outer guide 54. An upper portion of the inner space 26 may be formed between the upper body portion 51 and the flow path body portion 72. The flow path body portion 72 may face the upper flat surface F2 formed on the outer circumferential surface 51B of the upper body portion 51. The flow path body portion 72 may have a flat plate surface facing the upper flat surface F2.

The receiving space of the outer cover 70 may be formed between the flow path body portion 72 and the side cover portion 73, and an upper surface thereof may be blocked by the upper cover portion 71 and a bottom surface thereof is open.

The deco cover 90 may include a lower plate 91 covering a lower surface of the mounting portion 56 and a hollow tube portion 92 protruding from an outer circumference of the lower plate 91. The hollow tube portion 92 may be larger than the outer body portion 52. The hollow tube portion 92 may surround and protect the outer circumferential surface 52A of the outer body portion 52.

Figure 18:
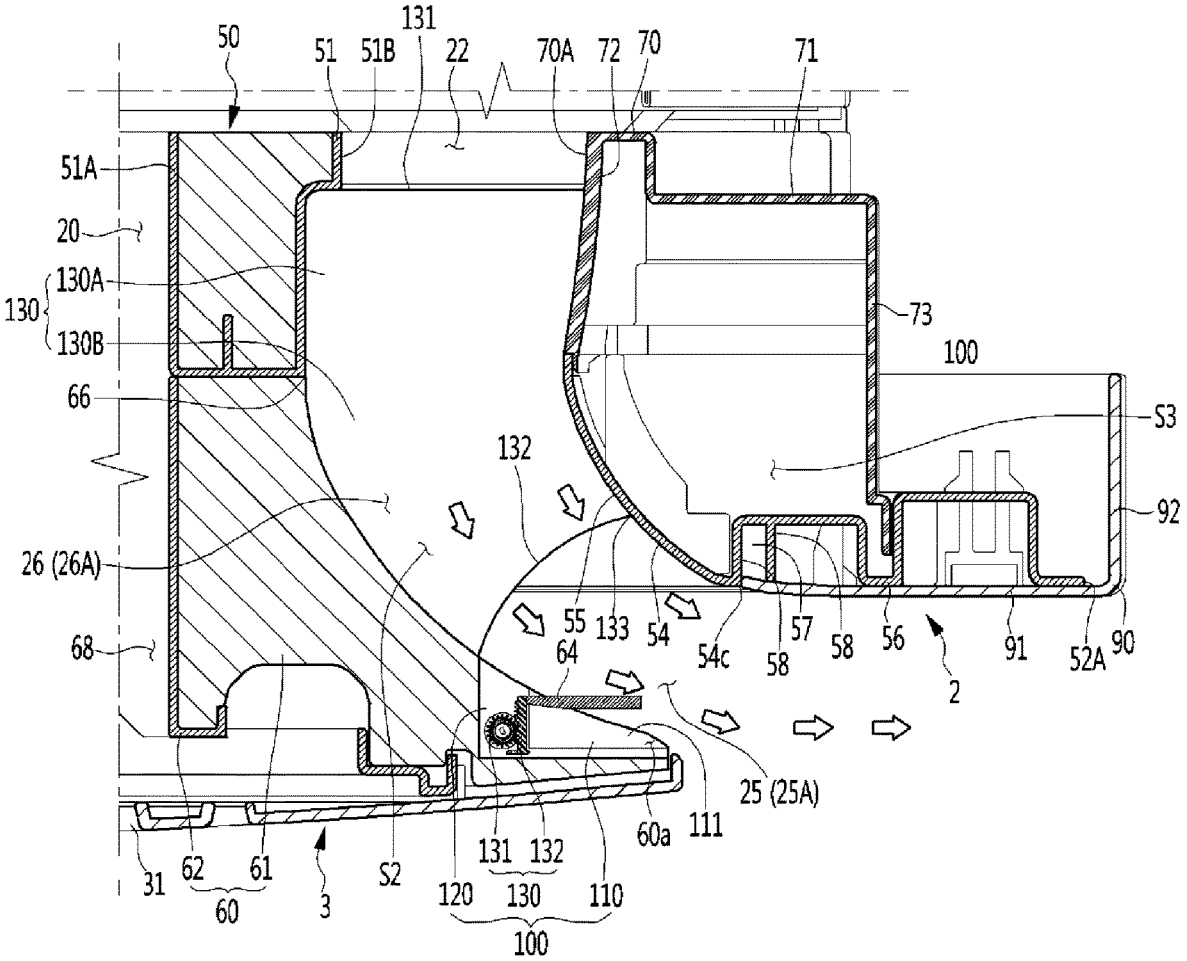
FIG. 18 is a cross-sectional view illustrating an air flow ejected to a first opening region when an air guide is lifted in a ceiling type air conditioner according to the embodiment of the present disclosure.
Figure 19:
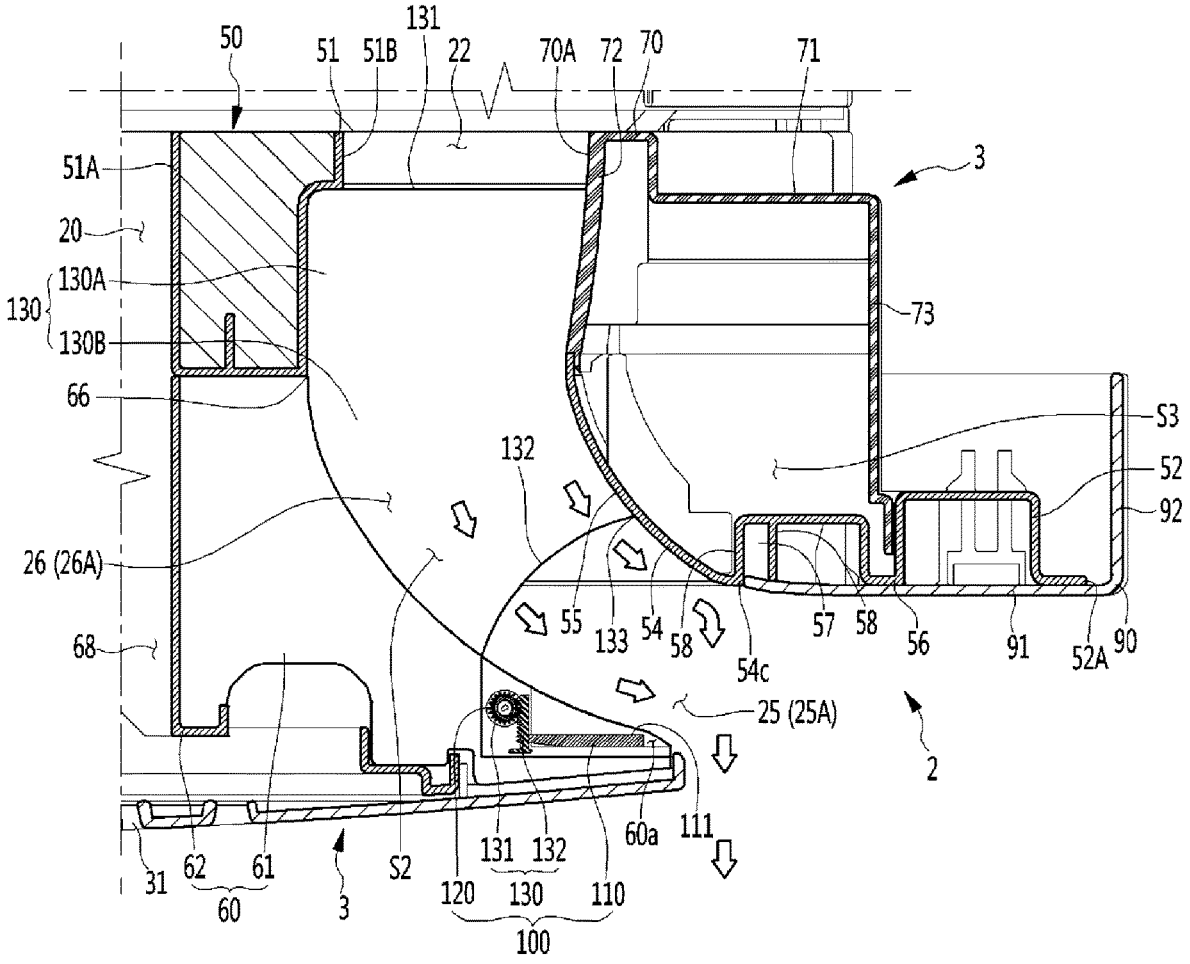
FIG. 19 is a cross-sectional view of air flow ejected to a first opening region when an air guide is lowered in a ceiling type air conditioner according to the embodiment of the present disclosure.

FIG. 18 is a cross-sectional view illustrating an air flow ejected to a first opening region when an air guide is lifted in a ceiling type air conditioner according to the embodiment of the present disclosure and FIG. 19 is a cross-sectional view of air flow ejected to a first opening region when an air guide is lowered in a ceiling type air conditioner according to the embodiment of the present disclosure.

As illustrated in FIGS. 18 and 19, the intake panel 3 may be disposed below the inner flow path body 60. The intake panel 3 may be disposed such that a portion thereof faces the lower hollow portion 68. The intake panel 3 may be disposed on the bottom surface of the inner flow path body 60. The intake panel 3 may have a plurality of through holes 31 through which air passes to be intaken into the lower hollow portion 68. All or some of the plurality of through holes may be located below the lower hollow portion 68.

Here, the through holes 31 may be air inlets through which indoor air is intaken into the ceiling type air conditioner.

For example, as illustrated in FIGS. 18 and 19, the air guide module 100 may include an air guide 110 liftably/lowerably disposed at the inner flow path body 60 and varying a flow of air discharged to the opening 25.

Specifically, as shown in FIG. 18, when the air guide 110 is lifted, the air discharged through the opening 25 may be guided in the horizontal direction guided by the air guide 110. When the air guide 110 is lifted, the air discharged to the opening 25 may be discharged as a horizontal air flow, while passing through an upper end 111 of the air guide 110.

In addition, as illustrated in FIG. 19, when the air guide 110 is lowered, the air discharged through the opening 25 is not affected by the air guide 110 and may be discharged as a vertical air flow in a discharge direction (vertical direction) of the opening 25.

An upper end of the air guide guiding the flow of air may be a flat surface. In addition, a surface of the air guide 110 guiding the flow of air may have a curved shape. In addition, the air guide 110 may have a circular shape, or may have an arc shape.

In addition, the air guide 110 may have a circular ring shape or an arc shape like the shape of the opening 25 when the ceiling is viewed.

For reference, a lower end of the air guide 110 may be formed as a flat surface and is liftably/lowerably arranged at the main flow path body 50, and thus, the air guide 110 may vary a flow of air discharged to the opening 25, while being drawn into or out from the main flow path body 50.

In the ceiling type air conditioner, one air guide may be disposed to be liftable and lowerable, and a plurality of air guides 110 may be arranged to be liftable and lowerable independently.

As another example, the air guide module 100 may be rotatably disposed at the inner flow path body 60 to vary a flow of the air discharged through the opening 25.

As another example, the air guide module 100 may be liftably/lowerably and/or rotatably disposed at the main flow path body 50 to vary an air flow of the air discharged through the opening 25.

When the ceiling type air conditioner includes one circular air guide, the ceiling type air conditioner may form a horizontal air flow when the one circular air guide is lifted, and form a vertical air flow when the one circular air guide is lowered. That is, when the one circular air guide is lifted or lowered, the ceiling type air conditioner may form only one horizontal air flow or only one vertical air flow.

In addition, the ceiling type air conditioner may include a plurality of arc-shaped air guides 110, and the plurality of arc-shaped air guides 110 may be lifted and lowered independently of each other. In this case, some of the plurality of air guides 110 may be lifted to form a horizontal air flow, and the other air guides 110 may be lowered to form a vertical air flow. That is, when the plurality of arc-shaped air guides 110 are lifted and lowered independently of each other, the ceiling type air conditioner may form a three-dimensional air flow including a mixture of the horizontal air flow and vertical air flow, and such a three-dimensional air flow may include various combinations.

Referring back to FIG. 17, the air guides 110 may be spaced apart from each other. There may be a space between a pair of air guides 110 adjacent to each other.

An end portion of the air guide 110 may be liftably and lowerably disposed at the first opening region 25A to guide air discharged to the first opening region 25A.

The air guide 110 preferably has an arc-shaped cross section. The air guide 110 may include a guide surface 111 that faces the first opening region 25A and guides the flow of air exiting the first opening region 25A.

The air guide module 100 may include a lifting part and/or a rotating part for the lifting/lowering and/or rotating operation of the air guide 110 as described above.

For example, the lifting parts 120 and 130 may include a power generating part 120 for providing power for lifting and lowering the air guide 110 and a power transmitting part 130 for lifting and lowering the air guide 110 upon receiving power from the power generating part 120.

The lifting parts 120 and 130 may be accommodated in the receiving space 60*a* formed concave downward at an edge portion of the inner flow path body 60. In addition, the air guide 110 may be fully received in the receiving space 60*a* when lowered. That is, the air guide 110 is drawn into or out from the inner flow path body 60, while being lifted and lowered. Here, when the air guide 110 is lowered, the upper end of the air guide 110 may be smoothly connected with the surface of the inner flow path body 60 without a step.

For example, the power generating part 120 may be provided as a motor for providing rotational power, and the power transmitting part 130 may include a pinion gear 131 connected to a rotary shaft of the motor and a rack gear 132 engaged with the pinion gear 131 so as to be lifted and lowered to lift or lower the air guide 110.

Accordingly, when the motor rotates, the pinion gear 131 rotates and the rack gear 132 engaged with the pinion gear 131 is lifted and lowered to lift and lower the air guide 110 connected to the rack gear 132.

The lifting parts 120 and 130 may be provided in plurality like the air guide 110, and the air guides 110 may be independently lifted and lowered by different lifting parts 120 and 130.

When two air guides 110 are provided, at least two lifting units 120 may be provided. In the ceiling type air conditioner, the plurality of lifting parts 120 and 130 may lift and lower the arc-shaped air guide 110 and, in this case, the plurality of lifting parts 120 and 130 may more stably lift and lower the arc-shaped air guide 110.

Hereinafter, an operation of the ceiling type air conditioner according to the present disclosure configured as described above will be described.

When the blower 4 is driven, air in the room may pass through the intake panel 3 and then pass through the upper hollow portion 20 of the discharge panel 2 and rise into the indoor unit 1.

The air rising into the indoor unit 1 may flow to the heat exchanger 5 by the blower 4 and may exchange heat with the heat exchanger 5 while passing through the heat exchanger 5. The air heat-exchanged with the heat exchanger 5 may pass through the plurality of blowing passages 7, 8, 9, and 10 and exit the indoor unit 1. In the indoor unit 1, a plurality of discharge air flows may be blown in the downward direction.

The air passing through the plurality of blowing passages 7, 8, 9, and 10 may be distributed to the inlets 21, 22, 23, and 24 of the discharge panel 2 and flow to the inner space 26 of the discharge panel 2.

Specifically, the air flowing through the inlets 21, 22, 23, and 24 may flow into the flow region 26A and may not flow to the blocking region 26B due to the barrier 130.

The air flowing through the flow region 26A may be discharged to the first opening region 25A of the opening 25, while being guided by the inner guide 64 and the outer guide 54. Specifically, the air flowing through the flow region 26A may be guided by the inlet facing surface 65A of the inner guide 64 and the guide portion 55A of the outer guide 54 and discharged to the first of the opening region 25A of the opening 25. Air may not be discharged from the second opening region 25B of the opening 25.

Here, since the air flowing from the inlets 21, 22, 23, and 24 does not flow to the blocking region 25B but is directly discharged to the first opening region 25A through the flow region 26A, the air flow discharged to the first opening region 25A may be fast in flow velocity and has strong straightness. Therefore, the cold air discharged to the first opening region 25A may not be returned to the through hole of the intake panel and dew may be prevented from forming on the bottom surface of the intake panel 3 due to return air.

A portion of the air discharged to the first opening region 25A may form an air flow in a downwardly inclined direction and the other portion thereof may form a horizontal air flow by the Coanda effect. In addition, when the air guide 110 is lifted, air discharged to the first opening region 25A through the flow region 26A may be guided by the guide surface 111 of the air guide 110 to form a horizontal air flow.

If the barrier 130 is not provided at the discharge panel 2, a portion of the air guided to the flow region 26A may flow to the blocking region 26B and discharged to the second opening region 25B. Here, the air flow discharged to the second opening region 25B may be slow in flow velocity and small in flow rate because portions of air of the pair of flow regions 26A adjacent to each other are mixed at the blocking region 26B and discharged. Therefore, the air discharged to the second opening region 25B may be blown back into the through hole 31 of the intake panel 3 and dew may form on the bottom surface of the intake panel 3. The barrier 130 prevents the air in the flow region 26A from flowing to the blocking region 26B, thereby preventing the air from being discharged from the second opening region 25B of the opening 25 and preventing air returning phenomenon and resultant due formation.

First, as shown in FIG. 18, when the lifting parts 120 and 130 lift the air guide 110, the upper end 111 of the air guide 110 may be formed as a flat surface parallel to the horizontal direction and lifted higher than the surface of the inner flow path body 60.

In addition, the upper end 111 of the air guide 110 may be inclined at various angles in a range that it rotates closer to the horizontality than the inclined angle of the inner flow path body 60.

In this case, the air passing through the first opening region 25A of the opening 25 through the flow region 26A may be discharged as an air flow close to horizontality, while being guided along the upper end 111 of the air guide 110 disposed in the horizontal direction and the outer guide 54 formed on the bottom surface of the main flow path body 50, and the air discharged to the opening 25 may be dispersed, while spreading widely into the room.

Meanwhile, as the lifting parts 120 and 130 lower the air guide 110 as shown in FIG. 19, the air guide 110 may be inserted into the inner flow path body 60. In this case, the upper end 111 of the air guide 110 may be received to be lower than the surface of the inner flow path body 60 so as not to interfere with the flow or may be received smoothly so as not to be stepped with the surface of the inner flow path body 60.

Therefore, the air discharged to the first opening region 25A of the opening 25 through the flow region 26A is not affected by the air guide 110 at all and may be discharged and guided as an air flow close to verticality according to a formation direction of the opening 25.

The ceiling type air conditioner may form an air flow closer to horizontality as the height of the air guide 110 is higher, and may form an air flow closer to verticality as the height of the air guide 110 is lower.

A lifting and lowering degree of the air guide 110 may be adjusted according to modes of the ceiling type air conditioner.

Figure 20:
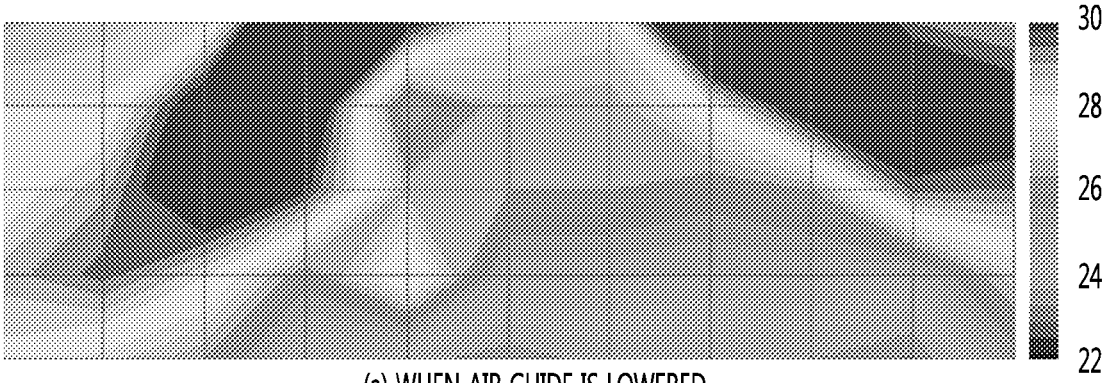
FIG. 20 is a view showing a temperature distribution according to whether the air guide shown in FIGS. 18 and 19 is lifted or lowered.
Figure 20:
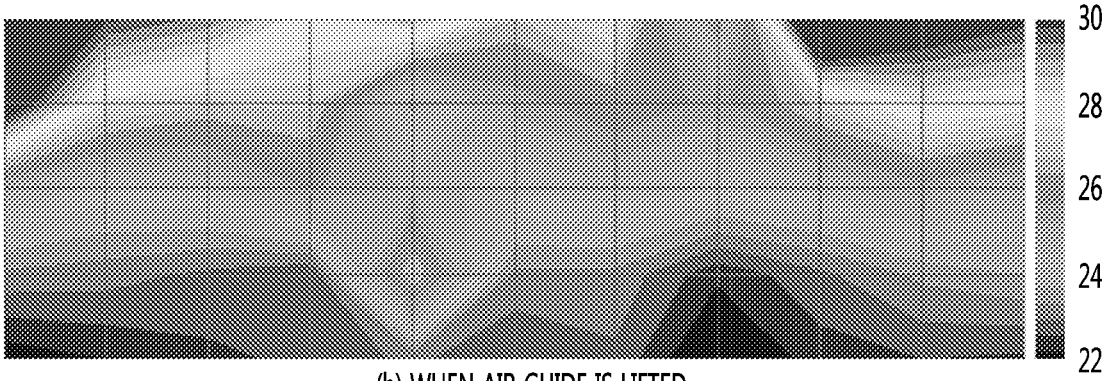

FIG. 20 is a view showing a temperature distribution according to whether the air guide shown in FIGS. 18 and 19 is lifted or lowered.

Referring to FIG. 20A, it can be seen that, when the air guide 110 is lowered, air discharged from the opening 25 is supplied downward while a vertical air flow is induced.

In a heating mode, the air guide 110 may be lowered and air discharged from the outlet 25 may form an air flow close to verticality.

The air passing through the opening 25 may have a temperature higher than that of the room and may be lighter than the room air. Therefore, it is preferable to lower the air guide 110 to form a vertical air flow so that hot air is directly discharged downward. That is, the ceiling type air conditioner may directly perform heating by lowering the air guide 110.

Meanwhile, referring to (b) of FIG. 20, it can be seen that, when the air guide 110 is lifted, the air discharged from the opening 25 is widespread in the horizontal direction as a horizontal air flow is induced.

In a cooling mode, the air guide 110 may be lifted and air discharged from the opening 25 may form an air flow close to horizontality.

The air passing through the opening 25 may have a temperature lower than that of the temperature of the room and may be heavier than the room air. Therefore, it is preferable to lift the air guide 110 to form a horizontal air flow so that low-temperature air is widely spread in the room. That is, the ceiling type air conditioner may perform indirect cooling by lifting the air guide 110.

The above description is only an example describing a technological scope of the present invention and various changes, modifications, and replacements may be made by those skilled in the art without departing from the spirit and scope of the present invention.

Therefore, the embodiments disclosed above and in the accompanying drawings should be considered in a descriptive sense only and not for limiting the technological scope. The technological scope of the present invention is not limited by the embodiments and the accompanying drawings.

The spirit and scope of the present invention should be interpreted by the appended claims and encompass all equivalents falling within the scope of the appended claims.

The invention claimed is:

1. A ceiling mounted air conditioner, comprising:

an indoor unit having a built-in heat exchanger and a built-in blower and comprising a plurality of blowing passages configured to discharge air which passes through the heat exchanger to the outside;

a discharge panel comprising a plurality of inlets that receives the air discharged through the plurality of blowing passages, an inner space configured to at least partially communicate with the plurality of inlets, and a ring-shaped or arc-shaped opening configured to discharge, to a room, air which flows into the inner space; and an air guide module mounted on the discharge panel and configured to be lifted/lowered or rotated to vary a flow of the air discharged to the opening, wherein the air guide module comprises:

at least one air guide liftably/lowerably or rotatably disposed at the discharge panel and configured to vary a flow of the air discharged to the opening;

a power generator configured to provide power for lifting/lowering or rotating the at least one air guide; and a power transmitter configured to lift/lower or rotate the at least one air guide upon receiving power from the power generator, wherein the at least one air guide has an upper end provided as a plane parallel to a horizontal direction.

2. The ceiling mounted air conditioner of claim 1, wherein the inner space of the discharge panel comprises a plurality of flow regions configured to communicate with each inlet, respectively, and allow air which flows through the inlet to flow therein, wherein a plurality of blocking regions is provided between the plurality of flow regions, and wherein the air guide module is mounted at the plurality of flow regions.

3. The ceiling mounted air conditioner of claim 2, further comprising:

a barrier configured to divide the inner space of the discharge panel into the plurality of flow regions and the plurality of blocking regions.

4. The ceiling mounted air conditioner of claim 2, wherein the plurality of flow regions and the plurality of blocking regions are alternately located along a circumference of the discharge panel.

5. The ceiling mounted air conditioner of claim 2, wherein the opening comprises a plurality of first opening regions corresponding to the plurality of flow regions and a plurality of second opening regions corresponding to the plurality of blocking regions, and wherein the air guide module is mounted at the plurality of first opening regions.

6. The ceiling mounted air conditioner of claim 5, wherein the plurality of first opening regions and the plurality of second opening regions are alternately located along a circumference of the discharge panel.

7. The ceiling mounted air conditioner of claim 1, wherein the power generator is provided as a motor configured to provide a rotating power, and wherein the power transmitter comprises a pinion gear connected to a rotary shaft of the motor and a rack gear lifted or lowered in mesh with the pinion gear to lift or lower the at least one air guide.

8. The ceiling mounted air conditioner of claim 1, wherein the discharge panel comprises:

a main flow path body comprising an upper body portion and an outer body portion provided on an outer side of the upper body portion, the upper body portion and the outer body portion being connected by a connecting portion; and an inner flow path body provided on an inner side of the main flow path body to form the inner space with the main flow body.

9. The ceiling mounted air conditioner of claim 8, wherein the air guide module is mounted at an end portion of the main flow path body or the inner flow path body.

10. The ceiling mounted air conditioner of claim 9, wherein the at least one air guide is drawn into or out from the main flow path body or the inner flow path body.

11. The ceiling mounted air conditioner of claim 10, wherein a surface of the air guide module which faces the inner space is configured as a flat surface to guide a horizontal air current when the air guide module is lifted, and to guide a vertical air current when the air guide module is lowered.

12. The ceiling mounted air conditioner of claim 8, wherein the main flow path body and the inner flow path body have an inclined surface inclined downward toward the opening.

13. The ceiling mounted air conditioner of claim 8, wherein the main flow path body and the inner flow path body have a surface which is curved so that the inner space forms a curved line toward an outer side.

14. A ceiling mounted air conditioner, comprising:

an indoor unit having a built-in heat exchanger and a built-in blower and comprising a plurality of blowing passages configured to discharge air which passes through the heat exchanger to the outside;

a discharge panel comprising a plurality of inlets that receives the air discharged through the plurality of blowing passages, an inner space configured to at least partially communicate with the plurality of inlets, and a ring-shaped or arc-shaped opening configured to discharge, to a room, air which flows into the inner space; and an air guide module mounted on the discharge panel and configured to be lifted/lowered or rotated to vary a flow of the air discharged to the opening, wherein the discharge panel comprises:

a main flow path body comprising an upper body portion and an outer body portion provided on an outer side of the upper body portion, the upper body portion and the outer body portion being connected by a connecting portion; and an inner flow path body provided on an inner side of the main flow path body to form the inner space with the main flow body.

15. The ceiling mounted air conditioner of claim 14, wherein the air guide module is mounted at an end portion of the main flow path body or the inner flow path body.

16. The ceiling mounted air conditioner of claim 15, wherein the air guide module comprises an air guide drawn into or out from the main flow path body or the inner flow path body.

17. The ceiling mounted air conditioner of claim 15, wherein a surface of the air guide module which faces the inner space is configured as a flat surface to guide a horizontal air current when the air guide module is lifted, and to guide a vertical air current when the air guide module is lowered.

18. The ceiling mounted air conditioner of claim 14, wherein the main flow path body and the inner flow path body have an inclined surface inclined downward toward the opening.

19. The ceiling mounted air conditioner of claim 14, wherein the main flow path body and the inner flow path body have a surface which is curved so that the inner space forms a curved line toward an outer side.

* * * * *